US006435979B1

(12) United States Patent
Mounfield, Jr.

(10) Patent No.: US 6,435,979 B1
(45) Date of Patent: Aug. 20, 2002

(54) GOLF PUTTER WITH SYMMETRICAL EXTRUDED SURFACES

(76) Inventor: William Pratt Mounfield, Jr., P.O. Box 399, Lexington, SC (US) 29071-0399

( * ) Notice: Subject to any disclaimer, the term of this patent is extended or adjusted under 35 U.S.C. 154(b) by 0 days.

(21) Appl. No.: 09/470,195

(22) Filed: Dec. 21, 1999

Related U.S. Application Data

(60) Provisional application No. 60/115,047, filed on Jan. 8, 1999.

(51) Int. Cl.[7] ..... A63B 53/00; A63B 53/04

(52) U.S. Cl. ..... 473/324; 473/340; 473/349; 473/341

(58) Field of Search ..... 473/131, 287, 473/290, 291, 324, 340, 341, 349, 348, 350, 313, 314, 251, 409

(56) References Cited

U.S. PATENT DOCUMENTS

| | | | | |
|---|---|---|---|---|
| 3,966,210 | A | | 6/1976 | Rozmus |
| 4,204,684 | A | * | 5/1980 | Molitor |
| 4,325,553 | A | | 4/1982 | Taylor |
| 4,444,395 | A | | 4/1984 | Reiss |
| 4,508,350 | A | | 4/1985 | Duclos |
| 4,693,478 | A | | 9/1987 | Long |
| 4,714,252 | A | | 12/1987 | Roraback |
| 4,869,507 | A | * | 9/1989 | Sahm |
| 4,898,387 | A | | 2/1990 | Finney |
| 5,058,895 | A | | 10/1991 | Igarashi |
| 5,078,398 | A | | 1/1992 | Reed |
| 5,131,656 | A | | 7/1992 | Kinoshita |
| 5,290,035 | A | | 3/1994 | Hannon |
| 5,340,106 | A | | 8/1994 | Ravaris |
| 5,439,222 | A | | 8/1995 | Kraneberg |
| 5,544,883 | A | * | 8/1996 | Meyer |
| 5,601,499 | A | | 2/1997 | Seagline |
| D404,099 | S | | 1/1999 | Mounfield |
| D406,293 | S | | 3/1999 | Mounfield |
| 5,911,948 | A | * | 6/1999 | Ratka |
| 6,012,989 | A | * | 1/2000 | Saksun |

* cited by examiner

*Primary Examiner*—Sebastiano Passaniti

(57) ABSTRACT

A golf putter head is characterized by one or more axis of symmetry, formed by an extrusion process. The extrusion has provisions for multiple styles, masses, lofts, lies, and colors, of golf club heads to be made from the same extrusion process and from the same extruded bar. Golf putter embodiments have provisions for differing head balances, including center, toe, and face balance in two faced, cavity back, or rounded back styles without changes to the extrusion process. The width of the putter may be altered for different total mass of the putter as desired. A novel method of securing mass and inertial altering material inserts is demonstrated with the use of wall tapered cavities which securely lock the insert material without the use of pins, screws, threads, or glues. Novel use of materials which expand upon cooling are introduce for these insert. The extrusion process has provisions for the production of golf clubs in general, for example, the heads for golf club woods, golf club irons, golf club putters, and golf club speciality heads, wedges, for example. The extrusion process allows golf club heads to be produced with high precision, yet low cost, in variable quantities in different materials, lofts, lies, widths, masses, shapes, and colors.

3 Claims, 20 Drawing Sheets

GOLF PUTTER WITH SYMMETRICAL EXTRUDED SURFACES

This invention is related and complimentary to the invention of our design patent D404099 issued Jan. 12, 1999 (Ser. No. 29/066,302, Filed Feb. 11, 1997), and our design patent D406293 issued Mar. 2, 1999 (Ser. No. 29/079,931, Filed Nov. 24, 1997). I also claim, pursuant to 35 U.S.C. §119(e)(i), priority of Provisional Patent Application Ser. No. 60/115,047 filed Jan. 8, 1999.

BACKGROUND—FIELD OF INVENTION

This invention relates to golf putters and golf clubs, specifically to an improved method for making golf clubs and golf club putters from extrusions with many embodiments and making golf putters with a high resistance to twist upon impact.

BACKGROUND—FIELD OF INVENTION

The art of hitting a golf ball with a golf club head produces a moment (twisting force) if the ball is not struck at the club's center of gravity. This is a so called "off-center hit." The twisting force opens or closes the club head face at impact so that the actual initial trajectory of the ball is not the intended trajectory. Unfortunately, it is unlikely that a golfer consistently hits the golf ball at precisely the center of gravity every time. Thus, one of the goals of golf club designers is to decrease the likelihood of off-center hits adversely affecting the trajectory of the golf ball by minimizing the effects of the twisting moment.

There have been many different design approaches to solve the no-twist problem for golf putter heads and golf clubs in general. These approaches may or may not be desirable from a manufacturing point of view. While it is effective to use exotic materials to solve the twisting moment problem by using light weight materials near the center of gravity of the club and very dense materials (tungsten for example) at the outer ends of the putter head, it is not cost effective to do so. Further, extensive machining of club heads from castings or billet materials can produce dynamically effective solutions, but not necessarily cost effective ones.

(Investment) casting of golf putter heads is the normal manufacturing method used today. With investment casting, designers strive to achieve the goals of the right dynamics and good looks while maintaining low manufacturing cost. Casting, in general, is a low cost for high volume approach to producing golf putters heads as well as irons and woods. However, casting these heads does not control the grain structure of the head since casting produces fairly homogeneous structures with randomly oriented grain structure. Further, casting methods may also produce voids in the heads as gas bubbles form in the cooling casting. Voids affect the dynamics, strength, sound, and uniformity of golf club heads, none of which is desirable.

The orientation of grain structure is desirable in ones own experience apart from golf clubs. Base ball bats are selected for gain structure, as are wooden mallets, wooden beams, wooden block floors for heavy machinery, machined metallic plates, etc., all of which are selected for their grain structure. From these examples, as far as the orientation of the grain, a grain structure which is oriented in line with the line of impact (baseball bats excepted) seems to be the most effective way for energy transfer. Croquette mallets or wooden mallets sound solid (and hit solid) because of their aligned grain structure. Thus, it seems that a golf putter head with an aligned grain structure would be also more effective in the transfer of energy.

Another important system of golf clubs (and golf putter heads usually) is the alignment system which helps the golfer align the club face perpendicular to the intended line of the golf ball. A simple analysis of the problem shows that a alignment error of one degree would produce an error of 10 cm (four inches) on a perfectly flat surface in a roll of 6 meters (20 feet). This error is approximately the width of the cup in the green. Alignment marks have been incorporated into golf putter heads for some time in order to reduce these alignment errors. It seems reasonable to incorporate the alignment principal into the design of the entire golf putter head: that of parallel and perpendicular lines and surfaces.

It also seems unlikely that one weight (mass) golf putter, one face loft, one shaft lie angle, one shaft length putter will suit all golfers. There are hundreds of variations (if not thousands) of mass, loft, lie, shaft length available to golfers today. It is desirable to be able to accommodate as many different models (with distinct features) into one basic design as possible. This would be done for market penetration reasons if not for manufacturing reasons. Thus, a design which allows for multiple configurations without any or few changes in machining would be very desirable.

Style considerations for golf club heads and golf putter heads specifically are restricted in at least two ways. One, the USGA will not allow but so much a departure from past conforming designs. Two, stylistic considerations from the users point of view may require proportionally and finish beyond that of just club head performance.

In conclusion, a most effective design would then incorporate all of the above, and achieve a dynamically sound, cost effective, uniform, solid feeling, easy to align, golf putter design which can be customized to many different golfers.

The following previous patents by other inventors have attempted to solve one or more of the above goals. None of the previous inventions achieve all of these goals. A short description of the more notable applicable inventions follows.

U.S. Pat. No. 4,714,252 to Roraback, Harry G. (Dec. 22, 1987): A golf putter with ball bearing heel-toe weight inserts is described in Roraback (U.S. Pat. No. 4,714,252). The ball bearings, being less dense than other materials such as lead, are located in hemispherical cavities running from the top surface to the sole. This putter lacks high mass moment of inertial achievable with other designs.

U.S. Pat. No. 4,898,387 to Finney, Clifton D. (Feb. 6, 1990): Finney (U.S. Pat. No. 4,898,387) describes a cast aluminum putter head with only the toe section containing tungsten like inserts (in the abstract lead inserts are described). This is an extremely complex head with many machining steps. It also appears to have a fairly flexible hosel considering the mass moment of inertia claimed.

U.S. Pat. No. 4,693,478 to Long, Dabbs C. (Sep. 15, 1987): A offset hosel (towards ball) with severe face balance is described in Long (U.S. Pat. No. 4,693,478). The higher moment of inertia is achieved by the severe machining of an aluminum casting at the back of the putter head. The face balance is achieved with a large face bias offset hosel. This is an example of a single-sided, face-balance putter head. Mention is made for different masses; however, with the offset hosel design, no mention is made as to the design being able to accommodate different face lofts and shaft lies while achieving the same balance.

U.S. Pat. No. 5,131,656 to Kinoshita, Frank (Jul. 21, 1992): Another one striking face heel-toe weighted golf putter head is described in Kinoshita (U.S. Pat. No. 5,131,656). This putter is claimed to be so called "gravity balanced " by Kraneberg below (herein we use center balanced) but is claimed to be face balanced by Kinoshita. A center (gravity) balanced putter hangs in no preferred orientation when the putter's shaft is placed on a flat surface normal to the direction of the force of gravity. This is one of the few if only reference to such a balance method. The Kinoshita putter has a hosel to attach the putter shaft to the putter head. The addition of a hosel increases the mass of the putter while minimally increasing the mass moment of inertia about the shaft, both of which are not desirable. Further, the complexity of the hosel, either in the machining or the casting of the putter head, does not warrant the addition of a hosel versus a direct attachment. The hosel design complicates the incorporation of different shaft lies. The Kinoshita invention does appear to have a constant radius sole, but no claim is made for this characteristic.

U.S. Pat. No. 5,340,106 to Ravaris, Paul A. (Aug. 23, 1994): Ravaris (U.S. Pat. No. 5,340,106) describes a design of a putter whose shape alone moves material to the heel and toe in order to increase the moment of inertia. However, this putter also has runners on the sole which would require an exact match of the shaft lie to a particular golfer to prevent abnormal scuffing of the putter head.

U.S. Pat. No. 5,290,035 to Hannon, Richard H; Schmidt, Jacob. H. (Mar. 1, 1994): A neutral balanced putter is described in Hannon (U.S. Pat. No. 5,290,0350). The description and figures describe a center balanced, one putting face, putter head. The putter is not symmetric about an axis which will require two different blanks for left and right hand putters. The mass and inertia increasing insert chambers run from the sole to top of the putter head and are only a golf ball width apart, which limits the potential mass moment of inertia with respect to the total putter head mass. Also, the chambers are varied in volume so as to balance the rotation of the putter head about the shaft. This volume changes requires another machining setup with possible different tools.

U.S. Pat. No. 5,078,398 to Reed, Timothy R.; Karner, James E. (Jan. 7, 1992): Reed (U.S. Pat. No. 5,078,398) describe a relatively high-moment of inertia golf putter head with claimed center balancing. A machined or casted void is filled with low density material (urethane) at the center of the head. This is a classic cavity-backed, hosel-to-shaft attachment, single striking surface, golf putter head. This design requires a mirror image casting for the opposite hand version, plus it has highly machined surfaces of difficult to machine stainless steel. It is likely that this putter is in fact face balanced, not center balanced; further keeping the same balance for different face lofts and shaft lies would require a different hosel location for every combination.

U.S. Pat. No. 4,325,553 to Taylor, Dale W. W. (Apr. 20, 1982): Another cavity backed, face balanced putter with claimed high mass moment of inertia is described in Taylor (U.S. Pat. No. 4,325,553). It has one striking face and three weight insert cavities. The center weight cavity is not as effective as heel-toe placed cavities as far as enhancing the inertial-to-mass ratio. A bent shaft is required for face balancing of the putter. No mention is made of materials or of methods of casting or machining this putter head with its complex shapes and cavities.

U.S. Pat. No. 4,444,395 to Reiss, Morton M. (Apr. 24, 1984): A heel-toe weighted putter with changeable heel-toe inserts is described in Reiss (U.S. Pat. No. 4,444,395). This putter does describe different possible widths and depths. However, no mention of different face loft or shaft lie is made and the putter head is not extruded.

U.S. Pat. No. 4,508,350 to Duclos, Clovis R. (Apr. 2, 1985): An aluminum casting putter head is described in Duclos (U.S. Pat. No. 4,508,350). This face balanced, cavity backed putter has poured lead inserts held in place by cured epoxy mixed with the molten lead. This is another very complicated head to machine from a casting. The single alignment marking on this putter is a notch placed above a circular indicia.

U.S. Pat. No. 3,966,210 to Rozmus, John J. (Jan. 29, 1976): Two other heel-toe weighted putter head with hosel (and the problems associated with hosels) are described in Rozmus (U.S. Pat. No. 3,966,210). The heel-toe insert weights in these putter heads are placed at the extreme point away from the striking face, thus, these putters have a pronounced face balanced design. The inserts are in so-called wings so that the putter has either many surfaces to machine or many compound surfaces to finish.

U.S. Pat. No. 5,058,895 to Igarashi, Lawrence Y. (Oct. 22, 1991): An investment casting golf putter head and a driver head are described in Igarashi (U.S. Pat. No. 5,058,895). This putter head has its weighting high above the centerline of the ball striking surface; more over-spin is claimed, however, the shaft must bend for this to occur, which appears unlikely.

U.S. Pat. No. 5,601,499 to Seagline, Frank W. (Feb. 11, 1997): In Seagline (U.S. Pat. No. 5,601,499) a non-insert, cavity backed golf putter is described with a J-shaped cross section. The J-shape forms the sole of the putter. No mention of inserts or of balance is made, but this putter appears to be face balanced with a bent shaft attached to the body.

U.S. Pat. No. 5,439,222 to Kraneberg, Christian F. (Aug. 8, 1995): Kraneberg (U.S. Pat No. 5,439,222) describes another single putting face, hosel equipped golf putter. The inertia increasing inserts are located behind the putting face. Mention is made for varying the inertia without varying the balance; no mention is made for keeping the same balance with different shaft lofts and lies. In addition the Kinoshita invention uses mass insert cavities machined in the face of the putter head opposite to the putting face. The insert cavities are sealed by plugs screwed into the putter body.

The referenced golf putter head inventions in the above do not simultaneously meet the objectives of manufacturability, and versatility of design, dynamics, alignment, and style. Described below is a golf head manufacturing process and golf head design which achieves the following objectives with the following advantages.

Features of My Invention

My invention can reduce torque from the impact of a golf ball, promote accurate alignment of a golf putter with the objective line, allow multiple putter configurations for shape, mass, loft, and lie from the same basic putter cross-section, which can be made economically and simply from material extrusions.

The United States Golf Association (USGA) restricts the design of golf club woods and irons to remain conventional in design. The fewer restrictions on golf putters allow for more radical approaches to meet the no-twist objective. My golf putter head design can minimize the effects of a twisting moment by departing significantly from the conventional approaches of golf putter designs. Further, my design includes features to help align the club head face perpendicular to the intended trajectory. Also the golf putter head design described herein provides a unique approach to marrying manufacturing and design.

My invention can reduce the number of machining steps necessary to manufacture billet-like golf clubs without resorting to casting. The present invention provides for the reduction in machining steps by extruding a near-net shape of the club head. Fewer machining steps are required to fully achieve a "fully machined" club head when using near-net shape extrusions of any part. In fact, a putter head according to my invention can be formed from as little as two steps: cutting the extruded material to a desired width to form a putter head and machining a shaft hole.

The present invention provides the alignment of the grain structure of the club head by using near-net shape extrusions which are pulled (stretched) immediately after extrusion. The stretching of the extrusion further defines the grain structure of the extrusion beyond that of the as-extruded shape and this process further uniformly achieves material properties from extrusion bar to extrusion bar.

The present invention provides for the alteration of the width of the club head from the same extrusion to suit different applications and club mass. Different cross sections of the club heads are also provided for by the low cost ($100s) manufacturing of a new extrusion die.

Different placements of the club shaft for different applications are provided for in the present invention. Different shaft placements allow different club balancing, such as center balance, face balance, quarter balance, heel, toe, etc., balance from the same extrusion.

Also provided for is bulk surface coating for all but the putting face in the present invention. Bulk surface coating, such as anodizing or powder coating, on long extrusion lengths many times the width of an individual club head reduces the cost of applying the coating and provides for a uniform coating as well.

The current invention provides for the machining of different face slopes (loft angle or loft) from the same extrusion blank. Since the width may also be altered, the same mass head may be manufactured even for different face lofts.

Provisions are made for machining different club shaft slopes (lie angle or lie) in this invention from the same extrusion blank. The club shaft may be located in different locations on the club head. These different locations allow the same club balance if the lie angle is changes. Further, the different shaft locations provide for attaching and locating different club shaft styles, including straight shafts and one, two, or more bend shafts.

The present invention provides for one or two faced golf putter heads from the same extrusion blank. Other one face embodiments, if conforming to USGA rules, may have different shapes from the same extrusion blank, but they are restricted to one club face.

Provisions are made from the present invention to achieve different near-net shape (or machined) embodiments of convex curved sole, concave sole, cavity backed, or other mass altering configurations of the club head from the same extrusion blanks.

Although the extrusion process is used to produce one or more axis of symmetry, provisions are made for the machining away of this axis of symmetry (as for a face-to-face curvature of the club sole or different cavities in the heel, toe, sole, top or faces) while still retaining the benefits of low cost production of uniform property material.

The present invention provides for symmetric toe-to-heel embodiments so that single face club heads may be machined either left-handed or right-handed from the same extrusion blank. The symmetry also provides for machining of left and right hand club heads in exactly the same manner including the machining of the shaft hole with just an appropriate shaft hole offset.

Provisions are made for extruding the mass and inertia altering cavities for weight inserts directly into the extrusion. If these cavities are extruded the steps required to machine them are eliminated.

The present invention allows for altering the material of the club head to any extrudeable material including alloys of aluminum, magnesium, plastics (with or without strengthening fibers), low carbon steel, stainless steel, copper alloys, titanium and more. Further, plastics may be pulled through an extrusion die (pultrusion) with carbon fiber or glass or other suitable reinforcing material.

The locking of the mass and inertia increasing inserts is provide for in this invention by the double tapering of the inserts' cylinders from the outer diameters (at the club faces) to the interior of the club head. The placement of the inserts in different location of the club head using this locking method is also provided for in this invention.

The present invention provides for achieving a high inertia-to-mass ratio club head by either using high density inserts or head design (like cavity backed) or both in the same low cost material extrusion blank style.

Further provided is a consistent look (finish and surface uniformity) and feel (density, inertia, mass, center of gravity) in this invention by using extruded shapes with consistent material, size and surface properties. The basic advantage of using extrusions in a highly controlled process is used to achieve the invention advantages outlined above. Further, the same advantages can be extended to the manufacturing of other golf club heads from extrusions; for example golf club woods and golf club irons can be extruded.

Still further objects and advantages will become apparent from a consideration of the ensuing description and accompanying drawings.

Figure 1:
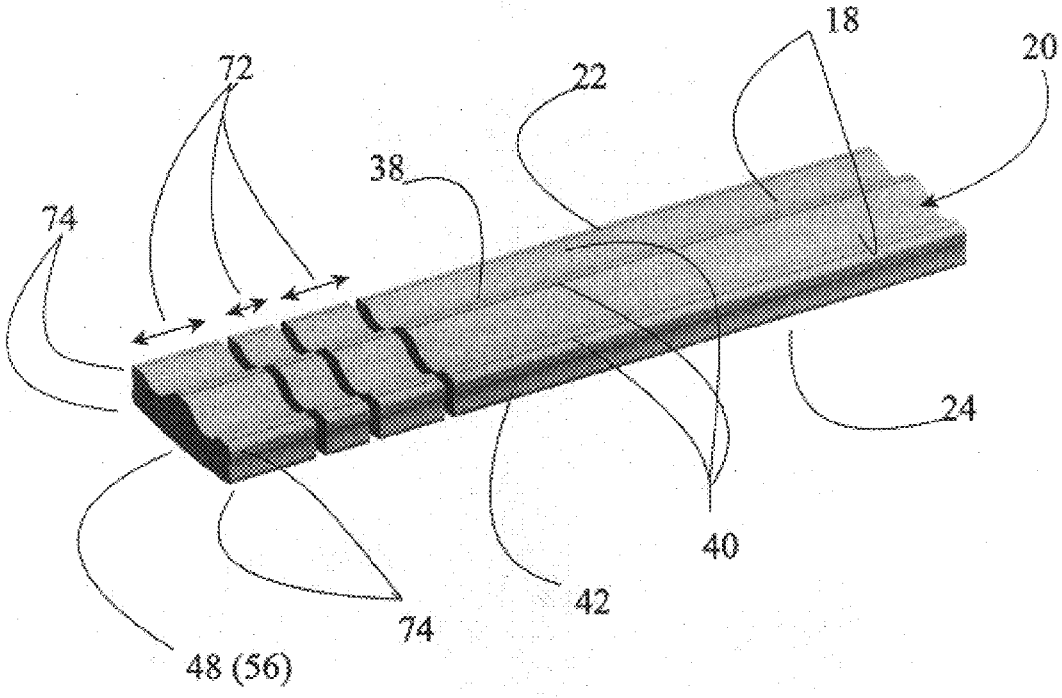
FIG. 1 is a exploded perspective view of a golf putter head extrusion showing several major characteristics of extruded golf club heads including different head widths.

| Reference Numerals | | | |
|---|---|---|---|
| in general | for flat sole 54 | for concave sole 56 | rounded back 58a |
| 12 putter shaft hole | | 12b putter shaft hole | |
| 14 front putter face | 14a front putter face | 14b front putter face | |
| 16 back putter face | 16a back putter face | 16b back putter face | 16c back putter back |
| 18 top surface contour | | 18b top surface contour | |
| 20 extruded shape | | | |
| 22 heel | | | |
| 24 toe | | | |
| 26 inserts | | | |
| 27 insert taper | | | |
| 28 swing axis | | | |
| 30 two conic cylinders | | | |
| 32 golf putter head | 32a golf putter head | 32b golf putter head | 32c golf putter head |
| 34 sole surface | 34a sole surface | 34b sole surface | |
| 38 top surface | 38a top surface | 38b top surface | |
| 40 alignment | | 40b alignment | |

-continued

| Reference Numerals | |
|---|---|
| grooves | grooves |
| 42 concave contours | |
| 44 top | |
| 46 bottom | 46b bottom |
| 48 sole | |
| 50 insert cavities | |
| 51 insert cavity taper | |
| 66 putter shaft hole axis angle | |
| 68 putter shaft hole offset from face | |
| 70 putter face loft | |
| 72 different putter widths | |
| 74 corner radiuses | |
| 76 fitting aid | |
| 78 fold lines | |
| 80 cut line | |
| 82a lie angle, right hand | |
| 82b lie angle, left hand | |
| 84 sight direction | |
| 86 sight center | |

| for cavity back embodiment 62a | for cavity back embodiment 62b | for cavity back embodiment 62c | for dual rounded back embodiment 32d |
|---|---|---|---|
| | | | 32d dual curvature rounded back head |
| 58a rounded back putter face | 58b rounded back putter face | 58c rounded back putter face | 58d dual rounded back face |
| 62a cavity back putter head | 62b cavity back putter head | 62c cavity back putter head | |
| 64a cavity | 64b cavity | 64c cavity | |

| for contour cavity back embodiment 32e | for contour cavity back embodiment 32f |
|---|---|
| 32e golf putter head | 32e golf putter head |
| 42e concave contours | 42f concave contours |
| | 58f rounded back putter face |
| 58e rounded back putter face | |

DESCRIPTION OF THE PREFERRED EMBODIMENTS

FIG. 1 Perspective View of an Extruded Shape 20 for Manufacturing Golf Putters from Near Net-shape Extrusions In FIG. 1 a perspective view of an extrusion shape 20 for the manufacturing of golf putter heads is shown. The extruded shape 20 is extruded in an extrusion die (not shown) whose exact shape is that of the cross sectional shape of the extrusion shape. The extrusion shape 20 can be extruded of different material. The preferred material for the embodiments to follow is an aluminum alloy, particularly 6105 with a T5 temper. Other aluminum alloys (6061 T6) and other metals, including magnesium, may be extruded to obtain different basic material properties of golf putter heads. A major feature of extruded shape 20 is that it contains at least one axis of symmetry along the extrusion axis. The extrusion shape 20 shown in FIG. 1 has two axis of symmetry in the preferred embodiment as a toe 24 side of the extrusion is a mirror image to a heel 22 side of the extrusion. A top surface 38 of an extruded shape 20 is not symmetrical to a sole 48 surface (which can be flat, concave, or convex); however, it could be if desired. The cross sectional shape of FIG. 1 is the same as FIGS. 46–90 in my design patent D406293 issued Mar. 2, 1999 (Ser. No. 29/079,931).

The extrusion process allows for many of the design features of end products, such as golf putters, to be machined into the extrusion die, and thus eliminating the machining of features in another step. The extrusion of the features on an extrusion shape 20, such as alignment grooves 40, heel 22 features, toe 24 features, concave contour 42 features, sole 25 contour, and top surface contour 38, reduces the final production cost of the products because these features are contained throughout the length of the extruded shape 20.

Particular to these embodiments herein, different putter widths 72 may be fashioned from an extrusion shape 20 to meet different golf putter specifications for total mass or for different configurations of putter heads. Typical golf putter head widths 72 are shown in relative terms in FIG. 1 in relationship to the extruded shape's 20 other dimensions. Typical extrusion shapes 20 are nominally 10 to 13 cm (4 to 5 inches), for example, from toe 24 to heel 22, and nominally 3.2 cm (1¼ inches), for example, from the sole 48 to the top surface 38. Extrusion lengths are approximately 15 to 17 meters (50 to 55 feet) in length, for instance, before cutting for heat treating and surface coating.

In order to consistently extrude the putter cross sectional shape standard die design methods have been adhered to. In particular, balancing of the extrusion forces requires relative balance of the extruded area from side to side and from top to bottom of the extrusion; the symmetrical current embodiment is easily extruded. Further, corner radiuses 74 at the comers of the club head extrusion are a generous 0.32 cm (⅛ inch), for example, and slight radiuses at the alignment grooves 40 are required to prevent excessive extrusion die wear.

Figure 2:
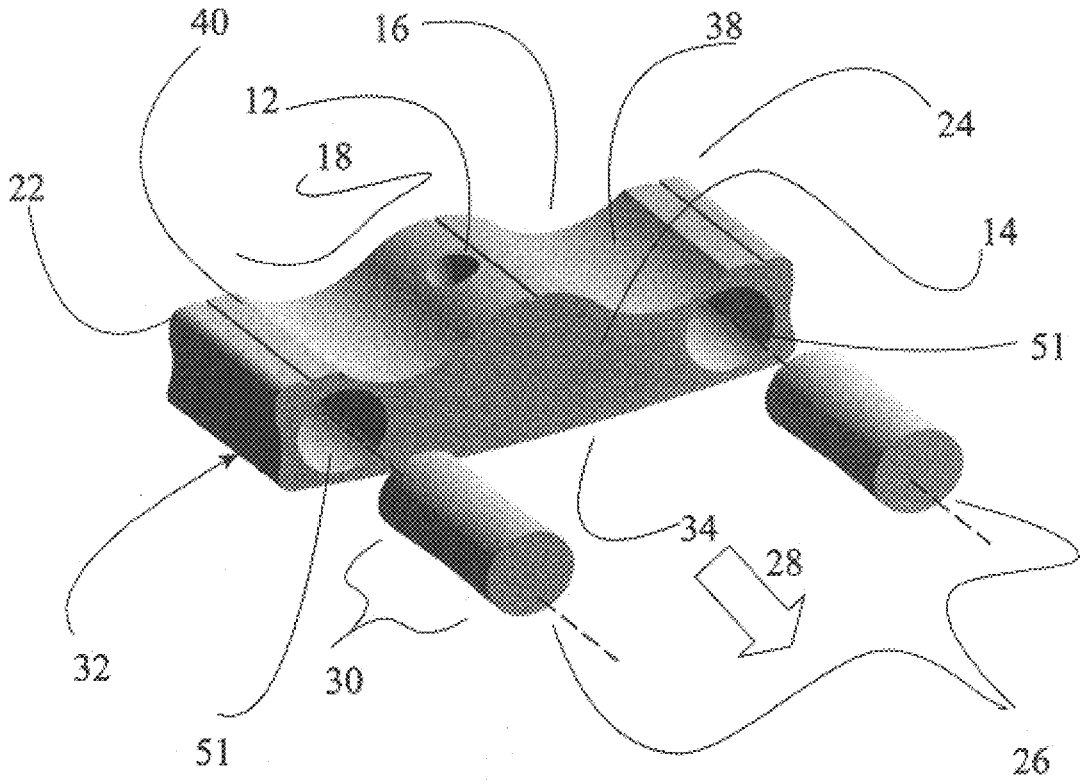
FIG. 2 is a exploded perspective view of one of the preferred embodiments of a golf putter head showing the golf putter head with weighting inserts.

FIG. 2 Perspective View of a Golf Putter Head 32 from Near Net-shape Extrusion FIG. 2 shows an exploded perspective view of one of the embodiments of a golf putter head 32. This golf putter head 32 is characterized by one or more axis of symmetry, one of which is along a swing axis 28 parallel to the ground. An axis of symmetry from a front putter face 14 to a back putter face 16 is the result of extruding a golf putter head 32 in a near net-shape extrusion process in order to achieve an extruded shape 20.

The golf putter head has provisions for a centrally located shaft (not shown) in a putter shaft hole 12, usually equidistant from the front putter face 14 and back putter face 16 in a two putter face embodiment; however, a putter shaft hole 12 location may be moved to achieve different club balancing criteria.

The front putter face 14 and back putter face 16 in this configuration are identical in profile and finish (as per USGA rules for dual face putters) in this two putting surface configuration. The golf putter's 32 front face 14 and back face 16 surfaces may be sloped from a vertical plane from the sole surface 34 (or bottom) to a face suited to a user's desires; this is the "loft" of the golf putter head 32and may be varied easily from 0 to +/−9 degrees, for example, as the USGA rules allow. A nominal width of this embodiment from extreme toe to heel is, for example, 10. cm (4.0 inches); a nominal depth from extreme sole to top is, for example, 3.2 cm (1¼ inches).

A top surface contour 18 is profiled in the horizontal plane to minimize the material near the middle of the golf putter head 32 while adequately supporting the shaft and at the same time providing surfaces and contours to aid in lining up the golf putter head 32 with the desired putting line. The top contour is defined, for instance, by three intersecting semicircles of nominal radius 1.8 cm (0.70 inches), for example, whose combined aligned cords measure 7.6 cm (3.0 inches), for example. At the outer ends of the semicircles are, for instance, two identical straight section of 1.3 cm (½ inch) width. These two straight sections and the three semicircles define the top contour, absent any alignment grooves. Other top surfaces 38 may be extruded as necessary to stay compliant with USGA rules.

Several alignment grooves 40 are evident in FIG. 2 extending perpendicular to and from the front putter face 14 to the back putter face 16. These alignment grooves 40 are extruded into the golf putter head 32 extrusion shape 20, and thus are not required to be machined after the putter is extruded. The alignment grooves 40 may be deeper, wider or both as desired. They can be, for instance, approximately 0.08 cm (0.03 inches) deep and 0.15 cm (0.06 inches) wide.

The width of the golf putter head 32 from the front putter face 14 to the back putter face 16 may be altered for different total mass of the golf putter head 32 as desired. The putter head mass is determined by the width and density of the extruded head and mass of inserts 26. With similar shaped inserts, the mass increases almost linearly with width. This provides for the easy manufacturing of different mass putters from the same generic extrusion. The weight of the putter heads can vary from as little as 100 grams to more than 400 grams, for example, with 295 grams {nominal 3.2 cm (1¼ inches) wide, for instance, from front face to back face} to 325 grams (nominal 3.8 cm (1½ inches) wide, for instance, from front face to back face} being a range of popular putter head masses.

A heel 22 and a toe 24 of the golf putter head 32 are shown in FIG. 2 oriented for left-handed or right-handed use since the putter head 32 is symmetric about a centrally located putter shaft hole 12. Located near the heel 22 and the toe 24 of the golf putter head 32 are weight inserts 26 each consisting of two conic cylinders 30 arranged back-to-back. Opposing tapers 27 of the two conic cylinder 30, shown clearly in FIG. 4 to follow, run from the middle of the inserts 26 to the outer ends lock the inserts in the golf putter head, which has corresponding double tape red 51 internal cylinders at the insert cavities 50 (shown clearly in FIG. 3 to follow). The preferred manner for forming the cylinders is by pouring or forcing of the material into the insert cavities. However, configurations are possible where the inserts are fastened into each other inside the insert cavities and are thus held locked into place by the actions of the opposing tape red walls.

The golf putter 32, originally fashioned in wood, may be made from aluminum, magnesium, stainless steel, steel, copper, or other metallic materials, and plastics, or other materials with denser (or even less dense) material inserts 26 in the horizontal plane of the putter head. A suitable aluminum extrusion material is 6105 with T5 temper. This material has similar physical characteristics (UTS, YS and hardness) of 6061 but with 6105 it is easier to maintain consistent physical dimensions during extrusion.

The overall cross sectional shape of FIG. 2 is the same as that in FIGS. 46–90 in my design patent D406293 issued Mar. 2, 1999 (Ser. No. 29/079,931); however, D406293 shows no insert cavities 50.

Figure 3:
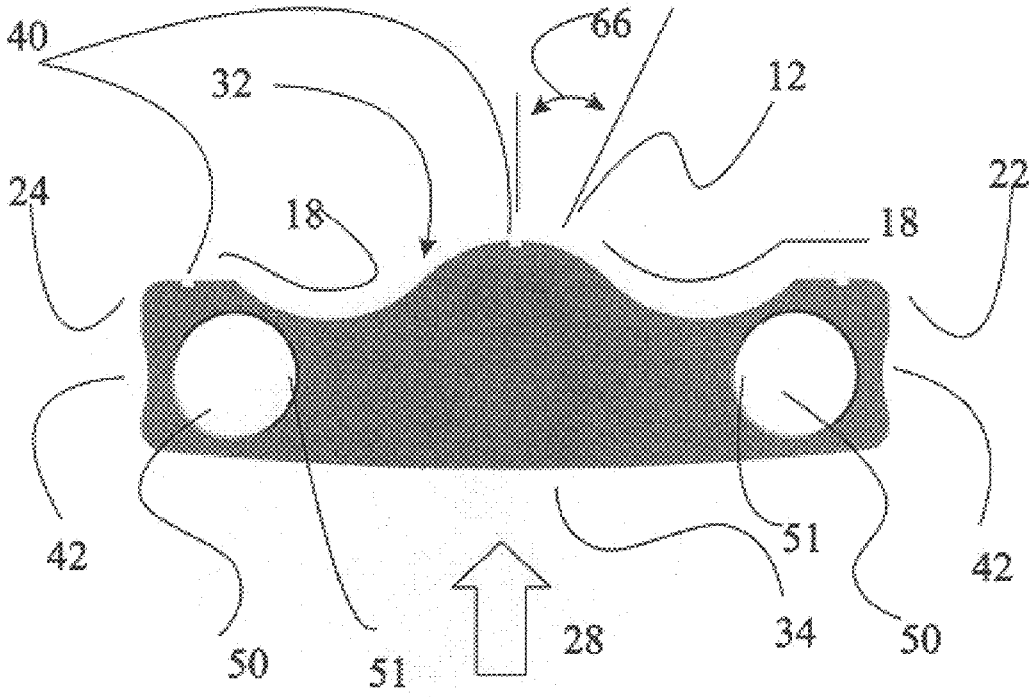
FIG. 3 is a front view of the configuration of FIG. 2 with multiple axis of symmetry.

FIG. 3 Front View of the Symmetric Golf Putter from Extruded Shapes

FIG. 3 shows symmetry with respect to another putter head axis. The symmetry of this embodiment of the golf putter head 32 from heel 22 to toe 24 is evident by the mirror profile image of the heel 22 with respect to the toe 24 of the putter head. This axis of symmetry about the center of the golf putter need not be designed so because this axis of symmetry is not along the extrusion axis, but perpendicular to it. This symmetry is, however, useful for balancing the extrusion forces from heel 22 to toe 24 which maintains consistent material thickness from one portion of the extrusion to another.

The symmetry also allows easy balancing of the golf putter head 32 about a putter shaft hole axis angle 66 with small adjustments of the position of the putter shaft hole 12 along the top surface 38 towards the heel 22. This adjustment is necessary to maintain the same balance of the golf putter head 32 for different putter shaft hole 12 angles (lie angle 66). The symmetry further provides for producing left and right-handed heads from the same extrusion with no modification except for the handedness of the shaft hole angle 66.

Also FIG. 3 shows the three alignment grooves 40 on the top surface contour 18 of the golf putter head 32. Three of these alignment grooves 40 are shown in this embodiment; but more or fewer may be added or subtracted respectively during the golf putter head 32 extrusion die machining. One of the alignment grooves 40 is centrally located at the center of gravity of the putter along the swing axis 28; the other two are equidistant from the center of the putter head, 1.3 cm (0.50 in), for instance, from the toe 24 and from the heel 22. The alignment grooves 40, however, need not be symmetrically located or even present.

The front view of the golf putter head 32 shows concave contours 42 at the heel 22 and toe 24 of the putter head. These contours are concave at the heel 22 and toe 24 to conform to a specific USGA rule on no more than two putting faces may be on any golf putter heads. The concave contours 42 spoil the putting face on the heel and toe. The contours may be convex as more conventional putter heads; however, concave contours 42 were chosen so that the golf putter head 32 could be held in machining jigs solidly by the heel 22 and toe 24 of the putter head. These concave contours 42 also maintain the strict rectilinear top view of the golf putter head 32 as shown in FIG. 2. The contours 42 can have nominally the same radius as the top contours 18 (1.8 cm (0.71 in)) and 0.08 cm (0.031 in) deep, for example.

A constant radius convex sole surface 34 of the golf putter head 32 is also shown in FIG. 3. A constant radius sole surface 34 was chosen for this embodiment of the golf putter head 32 so that point contact could be maintained if the lie angle of the golf club was not exactly matched to the golfer. The constant radius sole surface 34 can be approximately 46 cm (18 inches) radius, for example, but may be less or more. One embodiment of the golf putter head 32 has a flat sole surface 34 and is described below. Both of these embodiments (convex and flat) conform to USGA rules.

Insert cavities 50 are shown in FIG. 3 in the as-machined condition before any material is poured or placed into the insert cavities. The insert cavities 50 are identically machined near the toe 24 and heel 22 ends of the golf putter head 32 and nominally, for instance, on 7.9 cm (3⅛ inch) centers symmetric to the putter head. A minor diameter of the insert cavities 50 can be, for example, 1.6 cm (⅝ inch). A major nominal diameter of the insert cavities can be, for example, 1.7 cm (11/16 inch) with, for example, a 0.64 cm (¼ inch) per 30 cm (foot) taper. Depending on the width of the golf putter head 32, tapers on the insert cavities 50 coming from either putter face may or may not extend so that they touch along the insert cavity major axis; thus the finished minor diameter may be nominally, for example, 1.6 cm (⅝ inch), larger or smaller.

The overall cross sectional shape of FIG. 3 is the same as that in FIGS. 46–90 in my design patent D406293 issued Mar. 2, 1999 (Ser. No. 29/079,931); however, D406293 shows no insert cavities 50.

Figure 4:
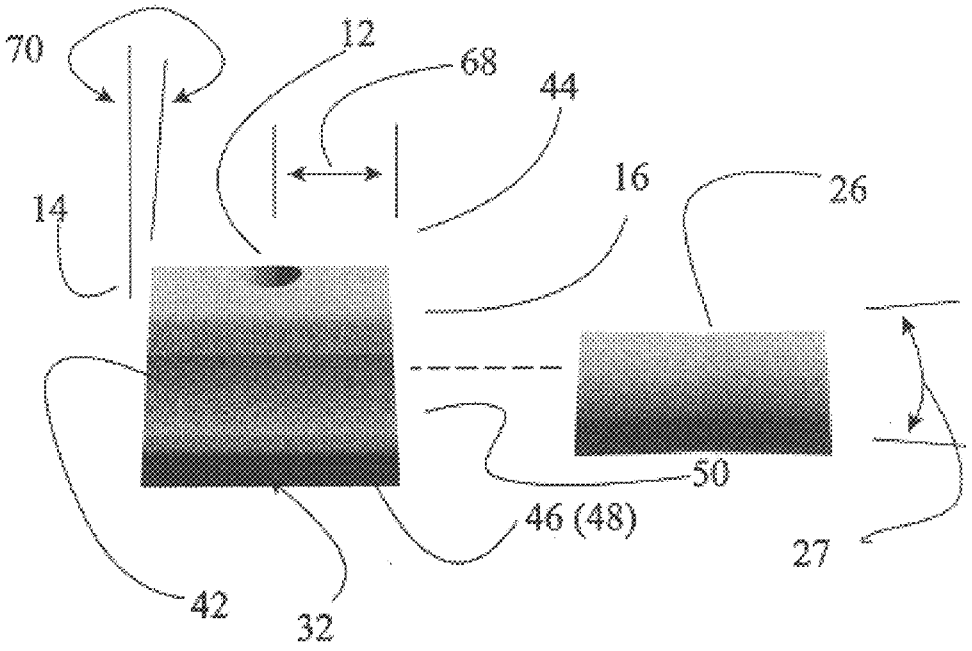
FIG. 4 is an end view of the configuration of FIG. 2 showing an example loft of both sides of a putter head and a side view of the weighting material for heel and toe inserts.

FIG. 4 End View of the Symmetric, Two Putting Surface, Putter Head

The end view of the golf putter head 32 as shown in FIG. 4, details the axis of symmetry of the extrusion process. The concave contours 42 running from the front putter face 14 to the back putter face 16 and described above in FIG. 3 are easily seen. The embodiment of the center balanced golf putter head 32 is demonstrated by the centrally located putter shaft hole 12 with identical putter shaft hole offset from putter face 68, either the front putter face 14 or the back putter face. Further, the end view in FIG. 4 shows the symmetry of the golf putter head 32.

The location of the concave contours 42 is arbitrary from a top 44 of the putter head to a bottom 46 (or sole 48) of the putter head but for this embodiment, for example, is placed near the middle of the end view of the heel 22 and toe 24.

The double-taper 27 of the inserts 26 is clearly shown in FIG. 4. The taper extends at or near from the center of each of the two conic cylinders 30 to their outer exposed surfaces at the putter shaft hole 12 and a front putter face 14 as well as a back putter face 16. The taper increases in diameter from the center of the inserts 26 to their outer ends. The taper need not start at the center, and may begin at a location closer to the front putter face 14 (back putter face 16), but is usually symmetrically machined; the nominal taper is, for instance, 0.64 cm (¼ inch) per 30 cm (foot). Insert cavities 50 inside the golf putter head 32 for the inserts 26 are tape red similarly towards the middle of each of the two insert cavities 50.

The two identical putting faces, consisting of the front putter face 14 and the back putter face 16 are shown with identical putter face loft 70 as is required by USGA rules for two faced golf putters.

The overall cross sectional shape of FIG. 4 is the same as that in FIGS. 46–90 in my design patent D406293 issued Mar. 2, 1999 (Ser. No. 29/079,931); however, D406293 shows no insert cavities 50.

Figure 5:
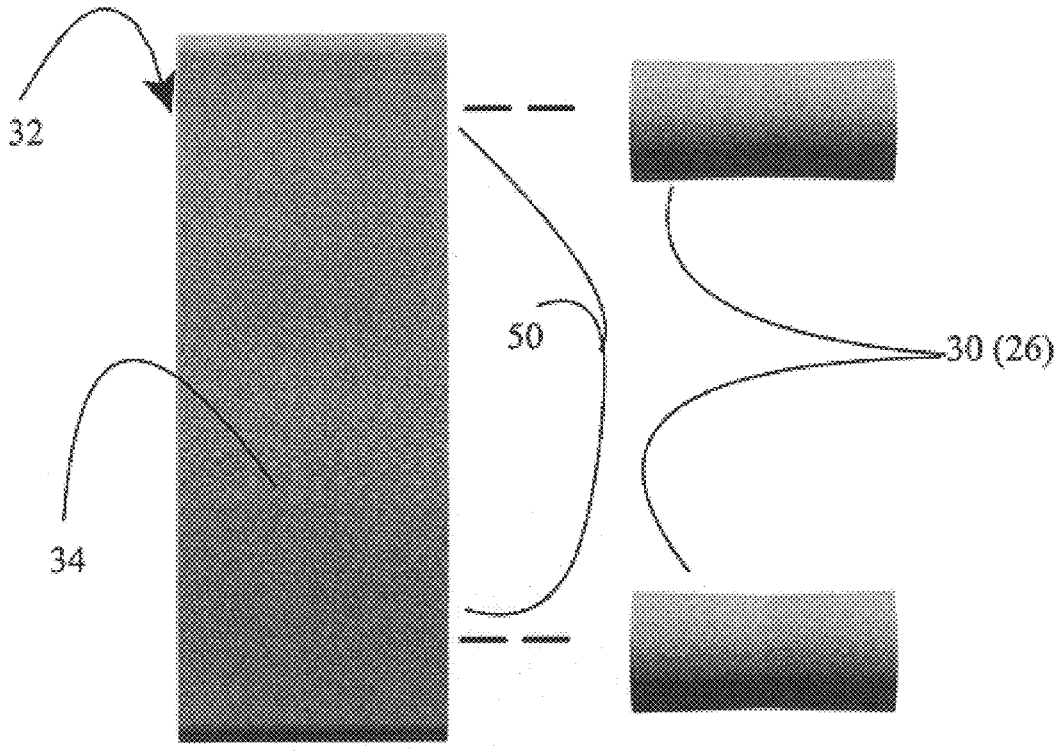
FIG. 5 is an exploded bottom view of the configuration of FIG. 2 showing the positioning of a heel and a toe weighting inserts.

FIG. 5 Bottom view of Extruded Golf Putter Head 32

In FIG. 5 the exploded bottom view of the extruded golf putter head 32 is shown with the putter head and another view of the two conic cylinders 30 or inserts 26 which fit into the insert cavities 50. The bottom view shows a sole surface 34 in plane view. Although relatively featureless in this plain view, a sole surface 34 could be marked for identification or partly machined away for a higher inertia to mass ratio, or to decrease the scuff area of the sole. However, in this embodiment the sole surface 34 is left as extruded and as anodized since the anodizing process forms a hard, wear resistant surface, and the constant radius affords a small scuff area on the sole.

The overall cross sectional shape of FIG. 5 is the same as that in FIGS. 46–90 in my design patent D406293 issued Mar. 2, 1999 (Ser. No. 29/079,931); however, D406293 shows no insert cavities 50.

FIGS. 1–5 Views of a Golf Putter Head 32 from Extruded Shape 20

The extrusion process, which forms the extruded shape 20 and the golf putter head 32 of FIGS. 1–5, allows many of the features of the golf putter head 32 to be designed in at the time of the extrusion die manufacturing. Designing in the features of the putter head significantly reduces the cost of the machining of the golf putter head 32 to final form. In other billet material heads almost every surface must be machined to produce a finished head. In an extrusion process producing such an extruded shape 20 most of the putter features do not require further machining.

Further, on account of the high pressure of extrusion the material structure "becomes more compact and its strength is increased . . . (and) the surfaces are smooth and free from flaws and other defects. The dimensions of the extruded shapes can be gaged with accuracy, so that they may be used directly with little or no or very little finishing." Machinery's Handbook, 22$^{nd}$ Edition, H. R. Ryffel & J. H. Geronimo, Eds., Industrial Press, 1984, pp. 2186–2187.

Another benefit of the extrusion process which generates an axis of symmetry by design is that the material properties of the extrusion blank may be also designed in and consistently maintained. Like the selected grain structure of a wooden mallet, the manufacturing process of stretching a 18–20 m or so length, for example, of extruded material forces the grain structure of the extruded bar to be consistently aligned along the axis of stretching. This grain axis is same axis as that of the golf ball contact, so the "feel" (solid in this case) and sound (a solid sounding ring) at impact are maintained from putter head to putter head. This process is completely different from machining putter heads from casting (random grain structure) or from metal stock (inconsistent grain structure), and is unique to this invention.

Further, the material properties of the extrusion bar for more or less UTS (ultimate tensile strength) may be altered by more or less stretching prior to heat treating and quenching. The process of stretching is very exact because the same length extruded bars are stretched the same amount, usually a meter or more, for instance, with a high degree of automated precision.

Another feature of the extrusion process is that surface coating (such as anodizing) of the golf putter head 32 may be done with long lengths (3 to 6 meters, for example) of the pre-machined putter head blank extrusion. This significantly reduces the cost of coating most of the surfaces of the putter head. However, the surface coating process (anodizing, hard anodizing, powder coating, dipping, etc.) may be delayed until after the club heads are partially or fully machined.

Not shown herein due to material finish contrast, the surface finish coating of the golf putter head 32 may be stripped out of the alignment grooves 40 prior to the machining of individual golf putter heads while the extrusion blanks are many meters long. This method of surface striping of the alignment grooves allows the consistent and inexpensive stripping of the coating for high contrast of the coating on the top surface contour 18 and raw material surface in the stripped-out alignment grooves 40. The preferred surface coating method is electrochemical anodizing in long extruded bar length to form a hard protective surface on the top, sole, heel and toe surfaces prior to further machining of the individual putter heads. The preferred surface coating is so called 'commercial grade' of thickness, for example, less than 0.05 mm (0.002 inches); for instance Wellcoat (© Wells Aluminum Corp.) 335blk (black). There are many other colors of commercial grade anodizing; for example, clear, light bronze, medium bronze, dark bronze, and more. In addition hard coating anodizing can also (electrochemically) formed which is approximately 0.1 mm (0.004) inches thick, for example.

Moving the putter shaft hole 12 towards the front putter face 14 of the putter makes the balance of the putter so called face balanced. This particular balance method (face balance) can be enhanced if the head was further machined to have a cavity back. Similarly, moving the putter shaft hole 12 towards the back putter face 16 would make the golf putter head back balanced. Other embodiments of the putter shaft hole 12 location could move the putter shaft hole 12 hole toward the heel 22 or the toe 24 of the golf putter head 32. Moving the putter shaft hole 12 towards the heel 22 would achieve so called toe balancing with the toe 24 hanging down when an assembled golf putter is held with the golf shaft horizontal to the ground.

The putter shaft hole 12 may be sloped more or less from the vertical to suit the users desires and conform to USGA rules; this is the "lie" of the putter (the putter shaft hole axis angle 66) and usually ranges from 10 degree to 25 degree, for instance, from the vertical more or less. The putter shaft hole 12 is machined to accept standard diameter steel {nominal 0.940 cm (0.370 inch) diameter tip, for example} or composite shafts without altering the golf putter shaft. The depth of the putter shaft hole 12 is machined so that when a standard, uncut golf putter shaft is epoxied into the putter shaft hole 12 the overall length of the golf putter is at or near 0.89 m (35 inches), for example, (measured down the shaft from the grip butt to the putter sole 48) without altering the golf shaft length. The nominal depth of the putter shaft hole is 2.5 cm (1.0 inches), for example. This design depth of the putter shaft hole 12 reduces the cost of cutting the golf shaft during assembly since the vast majority of golf putters are approximately 0.89 meters (35 inches) in length. Long style putters are provided for with a nominal shaft length of 1.23 m (48½ in), for example, using the same shaft hole machining as above, but with, for instance, a 10 degree shaft axis angle 66.

Also in the current embodiment, the putter shaft hole 12 is moved towards the heel end for flatter (larger included angle from the vertical) lie angles. The range of adjustment was experimentally determined to be approximately 0.33 cm to 0.076 cm, (0.13 to 0.030 inches), for instance, from the flatter to the more upright lie angles. This offset maintains the desired center balance characteristic of the golf putter head for constant depth shaft holes. If the same balance characteristics are not necessary then the offset can be the same for all shaft line angles.

The alignment grooves 40 along the top surface contour 18 of the golf putter head 32 serve as aids in the alignment of the front putter face 14 perpendicular to the intended line of the golf ball initial trajectory. In this particular embodiment three alignment grooves 40 are shown; one each alignment groove 40 at the heel 22 and one at the toe 24 portion of the top surface contour 18, and one centrally located near the putter shaft hole 12. There may or may not be an intersection of the putter shaft hole 12 with the center alignment groove 40 since the location of the putter shaft hole 12 relative to the heel 22 is different for different shaft angles. This adjustment is necessary to achieve the same balancing of the putter head with different lie angles.

As previously described, the width of the golf putter head 32 from the front putter face 14 to the back putter face 16 may be altered for different total mass of the golf putter head 32 as desired. The putter head mass is determined by the width of the extruded head and the inserts 26 (if used). With similar shaped inserts, the mass increases almost linearly with width. This provides for the easy manufacturing of different mass putters from the same generic extrusion. Almost any mass putter may be machined from the extrusions up to the realistic limit imposed by the USGA for the width (face-to-face) not exceeding the length (heel-to-toe).

The relative location of two conic cylinders 30 or inserts 26 is located in a manner to increase the moment of inertia.

In the preferred embodiments, inserts 26 are aligned with the swing axis 28 and poured into place, contained in two double conic cylinders 30 extending from the front putter face 14 to the back putter face 16 and located near a heel 22 and a toe 24 of the putter. The poured cylindrical inserts 26 may be double tape red from the middle of the putter to the front and back face forming two back-to-back cones in order to secure the inserts 26 without pins, screws, plugs or adhesives.

When insert material is poured into the insert cavities 50 it may be locked into position by one of more of the following process. One involves heating the putter head to 350–450° F., for instance, and then pouring a molten insert material, such as foundry lead, common bearing babbit, and monotype. Preheating the putter head beneficially expands the dimension of the insert cavities. Common lead insert material is not as suitable for inserts when the inserts are exposed to potential contact with the golf ball surface. Common lead is too ductile to withstand even minor impacts with golf balls or other clubs while the golf club is stored in a golf bag for transport, and common lead shrinks considerably when cooled (much more than the putter head body). However, foundry lead is much harder and less ductile than common lead and will withstand substantial impact. Another benefit is that the foundry lead expands when cooled. Common bearing babbitt, although is much harder than foundry lead or monotype, shrinks substantially when cooled and is it at least 5 times more expensive than foundry lead. Monotype is advantageous in that it expands upon cooling, is almost as hard as babbitt, and monotype is readily available; monotype is the preferred insert material for the inserts 26.

Alternatively, the inserts 26 can be further locked into the golf putter head 32 by mechanically compressing the insert material into the insert cavities 50 after the poured insert material has cooled enough to harden. The required pressure exerted on each of the two inserts 26 is less than 5 tons, for example, for even the widest putter head. A punch and die jig used in a press has been made to exert the necessary force. The combination of the expanding material for the inserts 26 (primarily monotype or foundry lead), the slight press fit, and the double tape red insert cavities 50 has proved to be a simple, economical and mechanically sound method to lock the inserts in the golf putter head 32.

Every characteristic to this particular preferred embodiment of length nominally 10 cm (4 inches), for instance, from heel to toe also holds for other length golf putter heads and golf club heads as well. These include heads for golf club "irons" and golf club "woods." The extrusion process does not place a limit on the length of the golf putter head (from heel to toe) which is not limited by USGA rules ) except by width-to-length ratio. The depth-to-length ratio does limit the extrusion process for stability of the extrusion, but this limit is far less than of practical importance to consistently impact a golf ball, since thin sections {0.25 cm (0.10 inch) or less, for example} can consistently be extruded. Of particular importance for extrusions with high length to depth ratios is the balancing of the extrusion forces; this can be maintained by symmetry or near symmetry as in the current embodiments both above and below. Thus, higher inertia to mass ratio embodiments can easily be designed, extruded, and manufactured with toe-to-heel lengths of 13 cm (5 inches), for example, or more with the same widths (face-to-face) as the current embodiments or less. Obviously, toe-to-heel lengths of less than the current embodiments can also be readily extruded.

Similar to extrusions, pultrusions for composite materials have at least one axis of symmetry. A shape identical to that in FIGS. 1–5 (and others below) could be "pulled" through an extrusion die using composite materials such as glass fibers and polyester resin. The pultrusion could then be machined to width, loft, lie, etc. the same as an aluminum extrusion.

Other Embodiments

Figure 6:
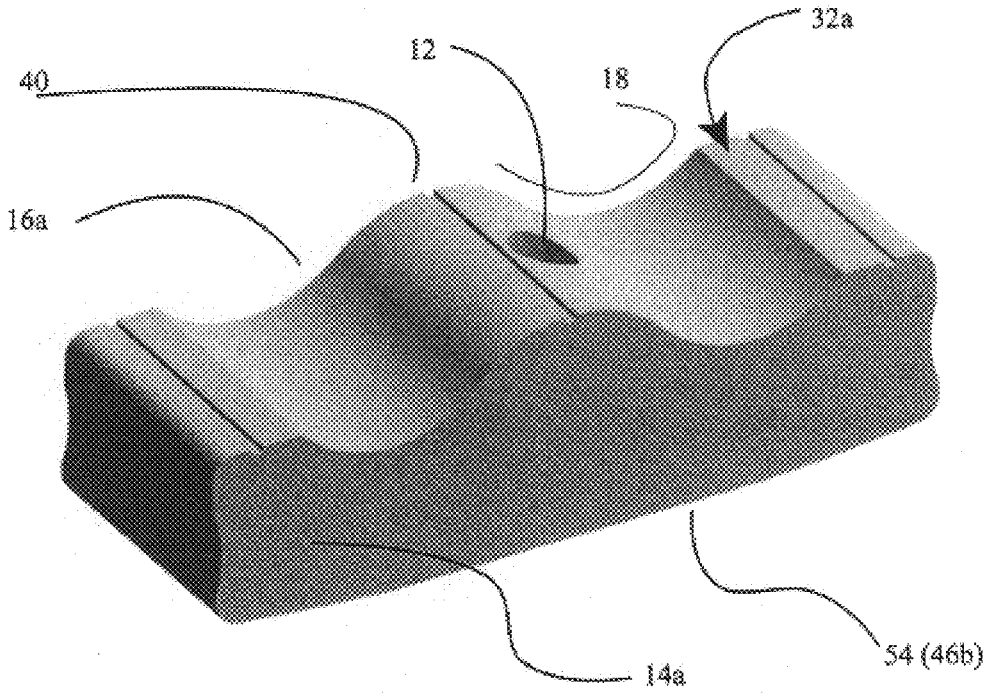
FIG. 6 is a perspective view of another embodiment according to the present invention, with a flat sole.

FIG. 6 Perspective View of a Flat Sole 54 Embodiment of this Invention

In FIG. 6 the perspective view of a flat sole 54 embodiment of this invention is shown. This shape (shown without inserts) may also be extruded as the convex sole 56 shape shown in FIGS. 1–5. A flat sole 54 golf putter head 32*a* shares most of the characteristics of the concave sole 56 designs. The flat sole 54 design has two identical putting faces, a front putter face 14*a* and a back putter face 16*a*. The top surface contour 18 is identical to that of FIGS. 1–5. The flat sole 54 design also has the same extruded alignment grooves 40 and the same putter shaft hole 12. The center balance character of the flat sole 54 putter head is identical to the convex sole 56 putter head. However, the flat sole 54 design has slightly less inertia-to-mass ratio than the convex sole 56 embodiment owing to more mass at the center of the putter head for the flat sole 54 embodiment. The flat sole 54 embodiment's only major difference from the convex sole 56 is that it has a flat sole. The flat sole 54 putter head may be made with all lofts, lies, widths, and inserts as the convex sole 56 embodiment of FIGS. 1–5. The convex sole embodiment of FIGS. 1–5 may be machined from the extrusion blanks of the flat sole embodiment and vice versa.

The overall cross sectional shape of FIG. 6 is the same as that in FIGS. 1–45 in my design patent D406293 issued Mar. 2, 1999 (Ser. No. 29/079,931).

Figure 7:
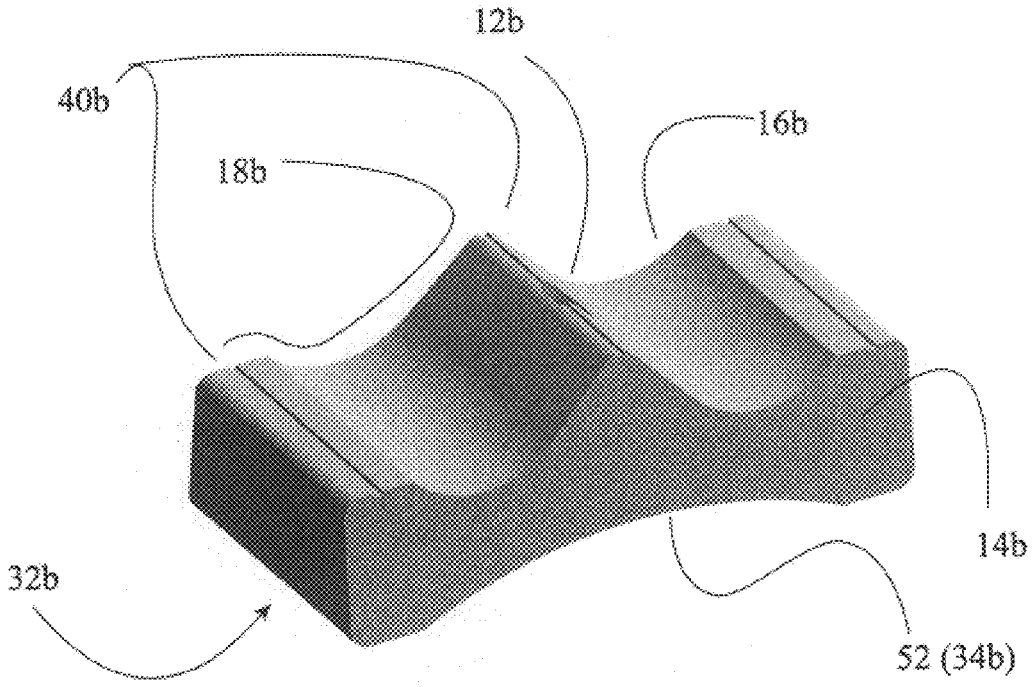
FIG. 7 is a perspective view of yet another embodiment according to the present invention, with a convex sole.

FIG. 7 Perspective View of a Concave Sole 52 Embodiment

In FIG. 7 a concave sole 52 golf putter head 32*b* embodiment of the current invention is shown in perspective view. Similar to FIG. 6 for the flat sole 54 embodiment, the concave sole 52 shares most of the descriptive characteristics of the convex sole 56 preferred embodiment shown in FIGS. 1–5. The concave sole 52 embodiment demonstrates the symmetry associated with extrusions. The head 32*b* has a front putter face 14*b* identical to a back putter face 16*b;* a top surface contour 18*b* with provisions for a putter shaft hole 12*b*. Further, this embodiment has similar alignment grooves 40*b*. The concave sole 52 embodiment 32*b* has a constant radius, machined or extruded, concave groove running from the front putter face 14*b* to the back putter face 16*b*. The mass-to-inertial ratio of the concave sole 52 embodiment is greater than either the flat sole 54 or the convex sole 56 embodiment since less mass is at the center of the putter head. Similar to the flat sole embodiment in FIG. 7, the concave sole 52 may have all the lofts, lies, and widths as the convex sole 56 embodiment of FIGS. 1–5.

The sole surface 34*b* of FIG. 7 is concave with a relatively short radius {10 cm (4.0 inches) nominal, for instance } concave section which extends from the bottom 46 of the putter head up into the golf putter head 32*b* for 0.64 (¼ inch), for example. This embodiment 32*b* allows more of the mass to be placed at the heel and toe of the putter head. The maximum height of the concave section stops below that portion of the golf putter head 32*b* which can strike the golf ball if the golf putter head is lifted no more than approximately 1.3 cm (½ inch), for example, above a resting position when positioned on a putting surface.

The overall cross sectional shape of FIG. 7 is the same as that in FIGS. 1–45 in my design patent D404099 issued Jan. 1, 1999 (Ser. No. 29/066,302).

Figure 8:
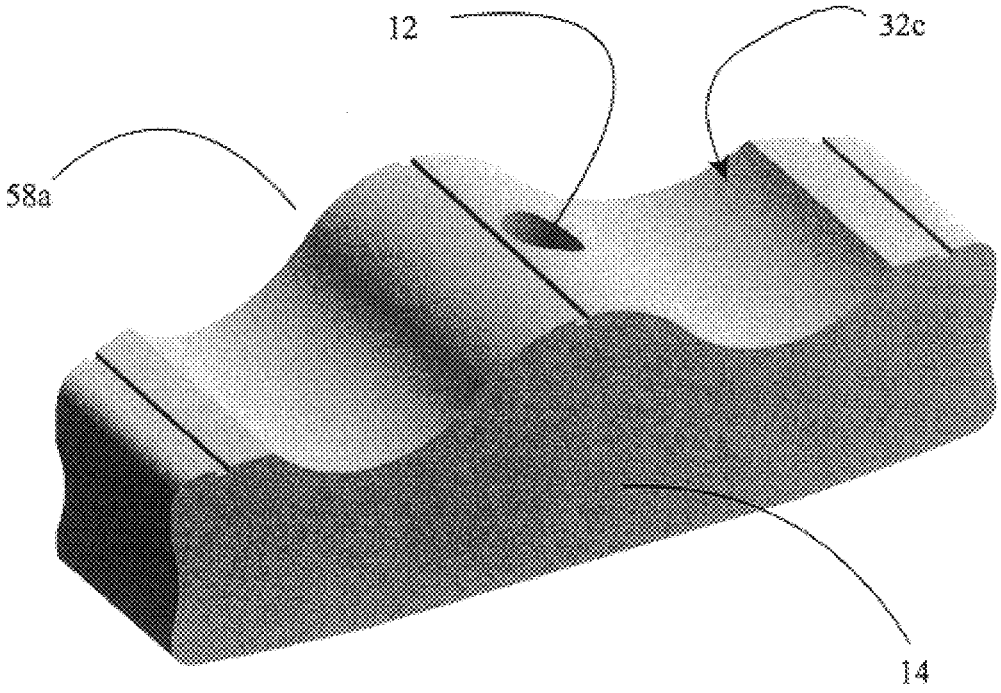
FIG. 8 is a perspective view of yet another embodiment according to the present invention, with one putting face, rounded back, and curved (convex) sole.

FIG. 8 A Perspective View of a One Putting Face, Rounded Back Face Golf Putter Head 32*c* Embodiment of an Extruded Golf Putter Head In FIG. 8 a one putting face, rounded back embodiment 32*c* of an extruded putter head with a rounded back face 58*a* opposite that of the front putter face 14. The rounded back 32*c* putter head has all the symmetry properties of the convex sole 56 embodiment shown is FIGS. 1–5, the flat sole 54 embodiment of FIG. 6, and the concave sole 52 shown in FIG. 7 except for the symmetry between the front putter face 14 and the rounded back 58*a* face. The putter shaft hole 12 is located toward {approximately 0.18 cm (0.07 inches) offset, for instance } the front putter face 14 in order to maintain the same center balance of the two-sided putter heads. However, the rounded back 58*a* embodiment putter head may be made face balanced by moving the putter shaft hole 12 even more towards the putting face {less than the 0.18 cm (0.07 inches) from the front face, for example, for the center balanced mode}. Thus, this rounded back 32*c* putter head may be center balanced, face balanced (or toe or heel) balanced by moving the location of the putter shaft hole 12. The above embodiments in FIGS. 2–7 may be center, heel, or toe but not face balanced in order to maintain conformity with USGA rules. If the rules do not apply, the embodiments in FIG. 2–7 may also may be face balanced with two identical putting surfaces.

Another attribute of the symmetrical embodiment of the extruded putters is that the either a left-hand or right-hand version of the rounded back 32*c* putters may be machined from the same extrusion. The only difference in the machining steps for the left handed putter head is that the putter shaft hole 12 is placed on the opposite side of extrusion, or on the "toe" side of a right-handed version. The rounded back 32*c* putter head may be machined with all lofts (on one putting surface), lies, and widths as in the two-putting face embodiments above in FIGS. 2–7. The widths may be altered on the rounded back 32*c* embodiment to exactly match the masses of the two-faced embodiments.

Figure 9:
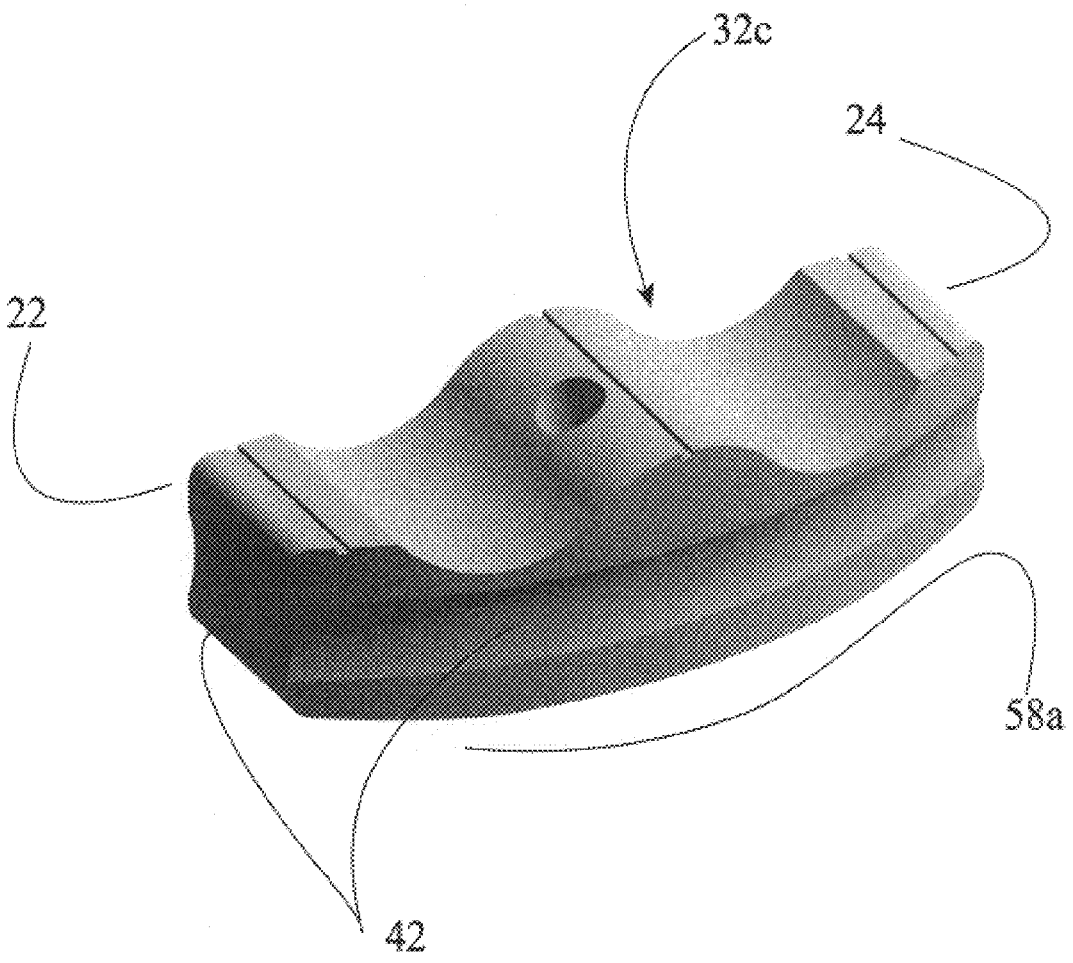
FIG. 9 is a perspective view from the back side of FIG. 8, more clearly illustrating the rounded back and the curved sole.

FIG. 9 Back Perspective View of a Rounded Back 32*c* Embodiment of the Symmetric, Extruded Golf Putter Head In FIG. 9 a different perspective view (from the back) is shown of a rounded back 32*c* embodiment of this invention. Shown in FIG. 9 for this embodiment of the rounded back 32*c* putter head is a concave contour 42 similar in radius to that on the heel 22 and toe 24. This concave contour 42 spoils the striking face on the rounded back 58*a*. One or more convex contour are also possible. Both the concave contour 42 and the convex contour versions may be made with different radius rounded backs 58*a;* versions have been made with radius from 5 to 20 cm (2 to 8 inches), for example. The USGA is more restrictive for rounded back 58*a* radiuses approaching or exceeding 20 cm (8 inches) with 10 cm (4 inch) radius being a nominal radius, for example.

Figure 10:
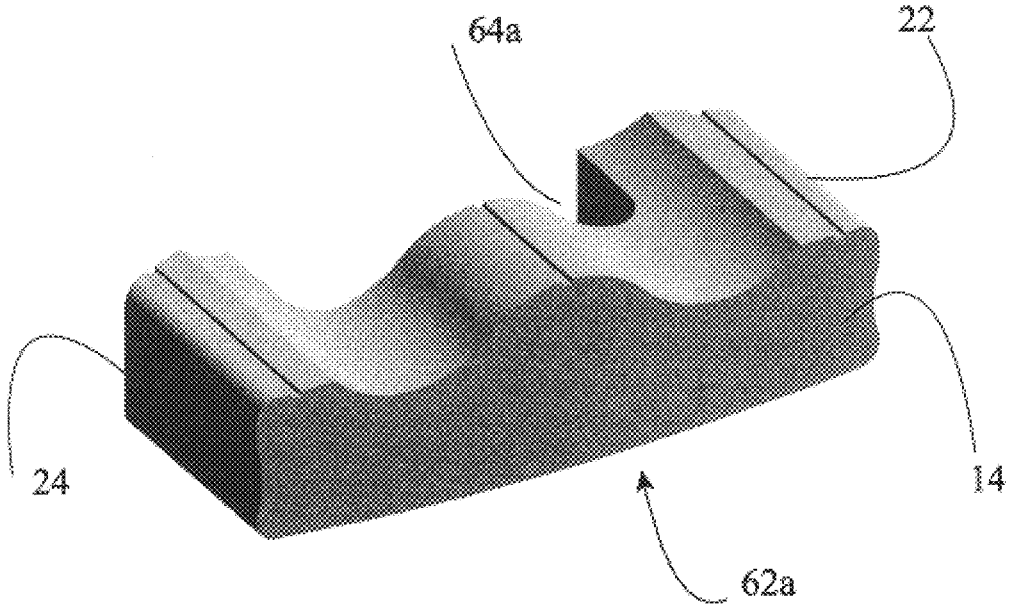
FIG. 10 is a perspective view of yet another embodiment according to the present invention, with a cavity back and one putting face.

FIG. 10 Cavity Back Golf Putter Head 62*a* Embodiment in Perspective View In FIG. 10 a perspective view of a cavity back golf putter head 62*a* embodiment of the convex sole 56 golf putter is shown. The cavity back golf putter head 62*a* embodiment uses the same extrusion profile of the two-putting face convex sole 56 preferred embodiment shown in FIGS. 1–5. The cavity back version enjoys all the benefits of the convex sole 56 version, being variations in loft, lie and width for different masses. There is, however, only one striking surface, the front putter face 14. As in the embodiment of FIG. 8, another one putting face embodiment, both right and left hand versions of the cavity back putter may be made from the same extrusion blank and manufacturing process. The last step of machining the putter shaft hole (not shown) mirrors the location of the putter shaft hole of either on the heel 22 end of a right hand version, or on the "toe" 24 end of the same "right hand" putter head. This is allowed because the putter heads are symmetric about the central vertical axis perpendicular to the putting face.

A cavity back golf putter head 62*a* embodiment has, as is implied, a cavity 64*a* machined in the back of the putter head on the side away from the front putter face 14. Different machined cavities are possible running in an area between the mass inserts (if included). A preferred cavity is one with generous radius sides {0.64 cm (¼ inch), for example} for visual appeal, manufacturability and structural integrity. The cavity back machining increases the ratio of mass moment of inertia to mass. The width of the cavity 64*a* can altered in order to match the mass of the two putter face embodiments (FIG. 2–7). Further, the putter shaft hole (not shown) must be offset towards the front putter face 14 in order to maintain center balancing; other balances are possible with different putter shaft hole locations as in the other single putting face embodiments. The preferred offset for is for face balancing with a nominal offset distance, for example, 0.97 cm (0.38 in) from the extreme leading edge of the front putter face 14.

Figure 11:
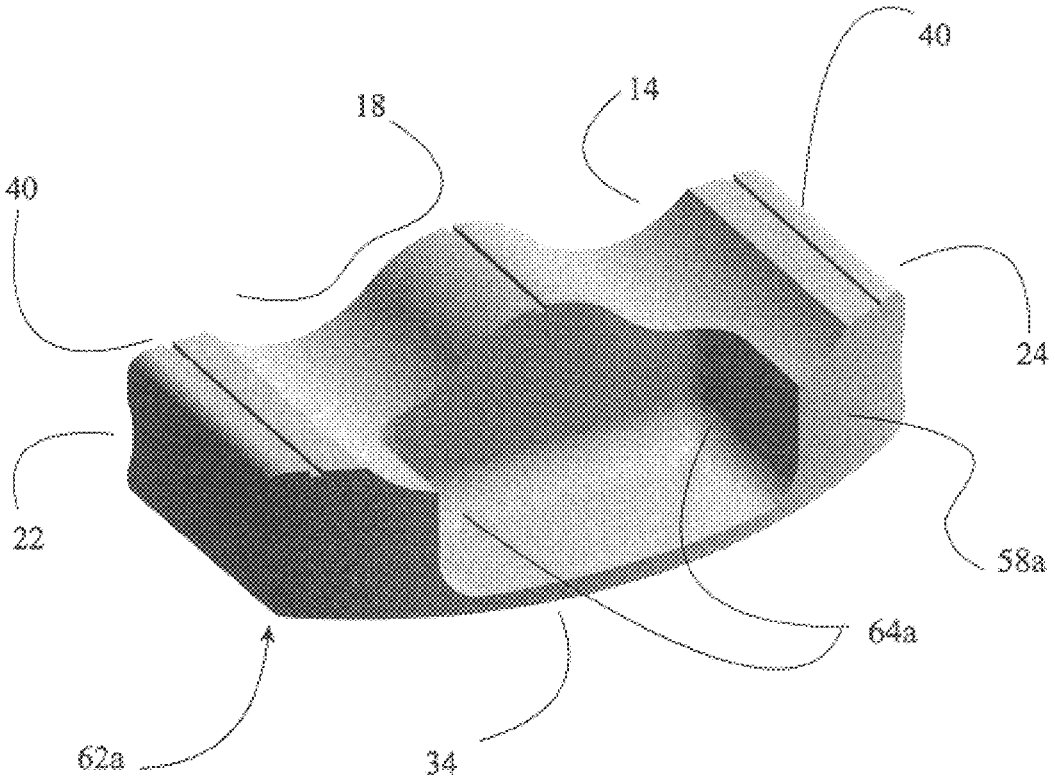
FIG. 11 is a perspective view from the back side of FIG. 10, illustrating the back cavity.

FIG. 11 Back Side Perspective View of a Cavity Back Golf Putter Head 62*a* Embodiment In FIG. 11 the back side perspective view of a cavity back 62*a* embodiment of the extruded putter is shown. The machining of the cavity 64*a* at the side of the putter opposite from the front putter face 14 runs from an area above a sole surface 34, leaving, for example 0.33 cm (0.13 in), so that a broad sole surface 34 is maintained, cutting through to the top surface contour 18, and running between the mass inserts (if used) near the heel 22 and the toe 24 with width, for example, of 5.4 cm (2.1 in). The depth of the cavity 64 from the back surface 58*a* towards the front face 14 is, for example, 2.5 cm (1.0 in) for a nominally 4.4 cm (1.8 in) width head 62*a,* for example. Also, the machined cavity 64*a* does not normally extend into two alignment grooves 40 nearest the heel 22 and the toe 24 of the cavity backed golf putter head 62*a,* but it may be designed so.

FIG. 12 Insert Cavity Tapers

Figure 12A:
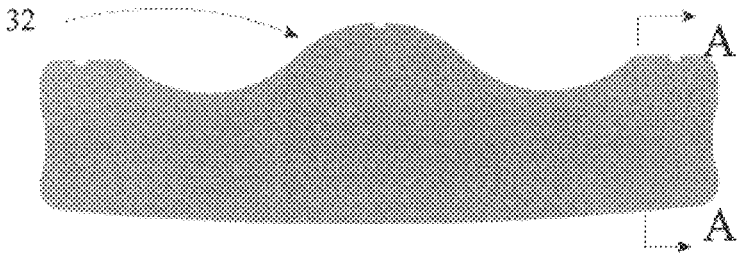
FIG. 12*a* is a front view of a putter body with section lines, 12*b* is a section view of a putter body with a tapered insert cavity, 12*c* is a section view of a putter body with a reversed taper, blind hole, insert cavity, and 12*d* is a section view of a putter body with a reversed taper insert cavity.
Figure 12B:
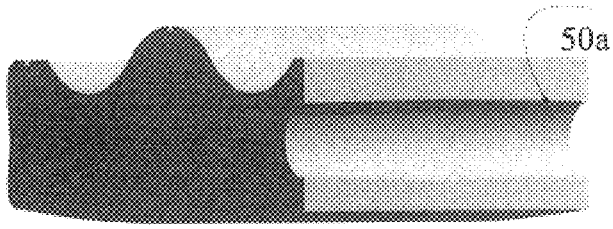
Figure 12C:
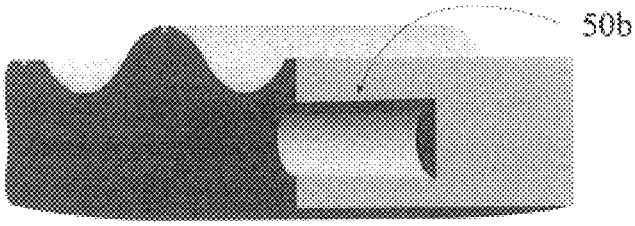
Figure 12D:
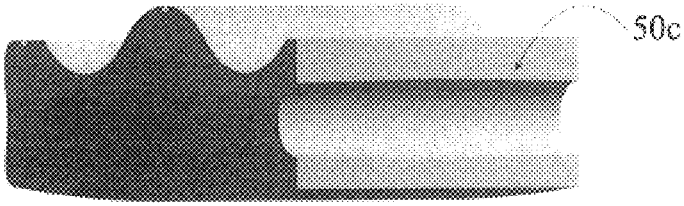

The face view of the golf club head 32 is shown in FIG. 12*a* without insert cavities to locate a section view A—A in FIGS. 12*b–d.* Similar to FIGS. 4, insert cavity 50, a sectioned insert cavity 50*a* in FIG. 12*b* has a insert cavity taper increasing in diameter from the center of the insert cavity to the putter faces. This insert cavity may be formed in a conventional manner with a common tape red reamer inserted into a pilot hole drilled through the putter. The tape red section cavity is shown as formed by the tape red reamer being inserted the same distance from both directions into the pilot hole so that the smallest diameter of the insert cavity is centered between the faces of the putter body; but this centering is not necessary and may be offset. The pilot hole's diameter may also form the innermost portion of the insert cavity so that the tapers from both sides do not meet, but intersect the pilot hole. This usually the case for thicker putter heads since the methods used form the cavities machine a predetermined and fixed outer taper diameter (major diameter) of 1.7 cm (11/16 inch) on both faces of a putter body 32.

Figure 13:
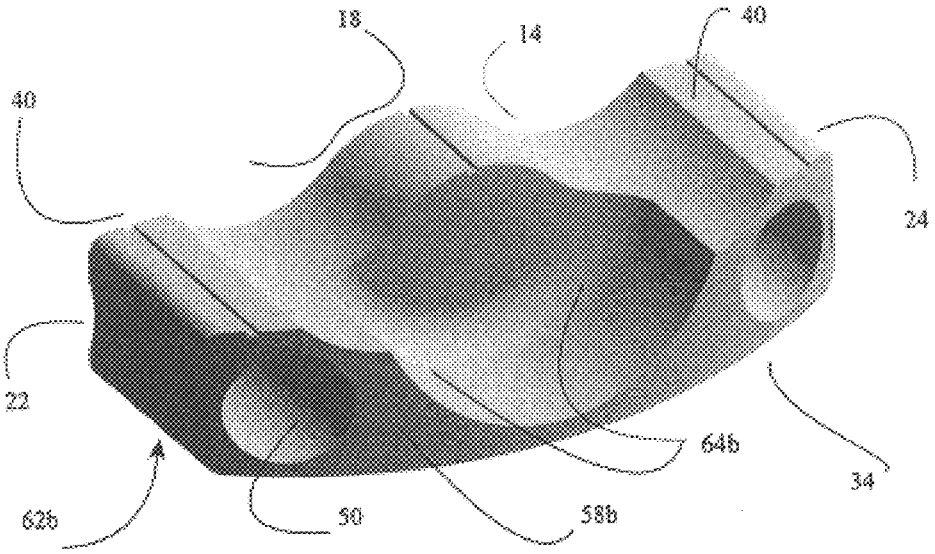
FIG. 13 is a perspective view from the back side of another embodiment according to the present invention, with a rounded back face with a rounded cavity back oriented in the face-to-face direction, and one putting face.

FIG. 13 A Perspective View of a Rounded Cavity, Cavity Back Putter Head Embodiment 62*b*

FIG. 13 is a perspective view of a cavity back putter head 62*b* embodiment from the back side according to the present invention, with a rounded back face 58*b* and a rounded cavity 64*b* in the back with the cavity 64*b* oriented in the face (14) to face (58*b*) direction. The cavity back putter head 62*b* has one putting face 14 which may be either the left-hand surface or the right-hand surface depending on the location of the shaft hole (not shown). In FIG. 13 if the shaft hole is located towards the heel end 22 and angled towards the heel end 22, the putter head 62*b* would be called a right-handed putter. The preferred shaft hole offset for this embodiment is towards the front face 14 to achieve a face balanced condition. The offset is such that the center of the shaft hole to the extreme leading edge of the front face 14 is, for example, 0.95 cm (0.38 in).

A top surface contour 18 is the same as in other embodiments in FIGS. 1–6, and FIGS. 8–11. Extruded alignment grooves 40, for example, are located at a toe end 24, a heel end 22 and on the top surface 18 at a mid point in between the two ends. A sole surface 34 has the same radius of curvature as in the embodiments shown in FIGS. 2–6, 8–11. Insert cavities 50, if present, may have the same taper and characteristics as in the embodiments of FIGS. 2–6, 8–11.

The primary differences between this embodiment and the embodiment of FIGS. 2–6 is the rounded back face 58*b* with a rounded cavity 64*b*. The rounded cavity 64*b* has a major radius of approximately, for example, 2.9 cm (1.1 in), more or less, oriented in the center of the putting face-to-back face axis, leaving approximately, for example, 0.32 cm (0.13 in), of the putting sole 34 at the center of the rounded back face 58*b*. The cavity 64*b* has a fillet radius of approximately, for example, 0.3 cm (0.1 in) more or less. The cavity extends into the rounded back face 58*b* a distance ranging from, for example, 1.3 to 2.5 cm (0.5 to 1.0 in), depending on the width of the putter head 62*b* and its final desired mass. The rounded back face 58*b* has a major radius of approximately, for example, 10 cm (4 in) oriented along a vertical axis passing through a sole 34 to top surface 18 axis, perpendicular to the major axis of the cavity 64*b*.

This cavity back embodiment 62*b* may have all the lofts, lies, and widths of the previous embodiments of FIGS. 2–6, 8–11. The cavity 64*b* increases the relative inertia-to-mass ratio for similar masses compared to the two putting faces embodiment of FIGS. 2–6. The depth of the cavity 64*b* may be varied for depth, major radius, location, and fillet radius in order to modify the total mass of the cavity back head 62*b*, and its inertia-to-mass ratio.

Figure 14:
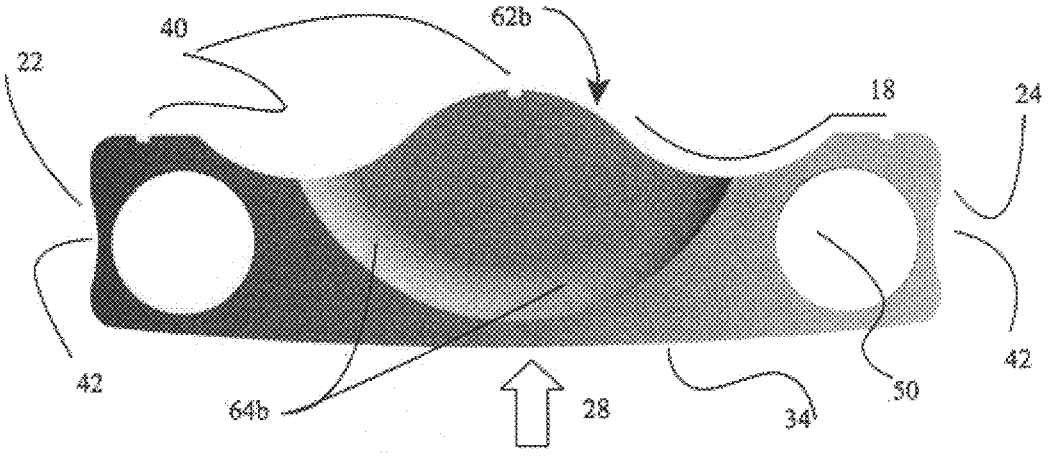
FIG. 14 is a back view of the rounded cavity back embodiment of FIG. 13 further illustrating the orientation of the rounded back cavity.

FIG. 14 A Back View of the Rounded Cavity Back Embodiment 62*b*

In FIG. 14 the rounded back embodiment with a rounded cavity 64*b* of FIG. 13 is further described in a back view. The radius of curvature of the cavity 64*b* is shown in plan view oriented in the putting face-to-back face plane, in line with the putting axis 28, and nominally centered, for example, between a heel 22 and toe 24 surface. The heel 22 end and toe end 24 each have a concave contour 42 to spoil the toe 24 and heel 22 from being used as a putting face. A top surface 18 has the same symmetrical contour as in the embodiments of FIGS. 2–6, 8–11. A mass insert cavity 50 is shown in each of the toe 24 and the heel 22 ends. The insert cavity may have the same characteristics and major and minor diameter dimensions as previously described for FIG. 3. Similarly, alignment grooves 40 may be as described in FIG. 3 for another described embodiment.

Figure 15:
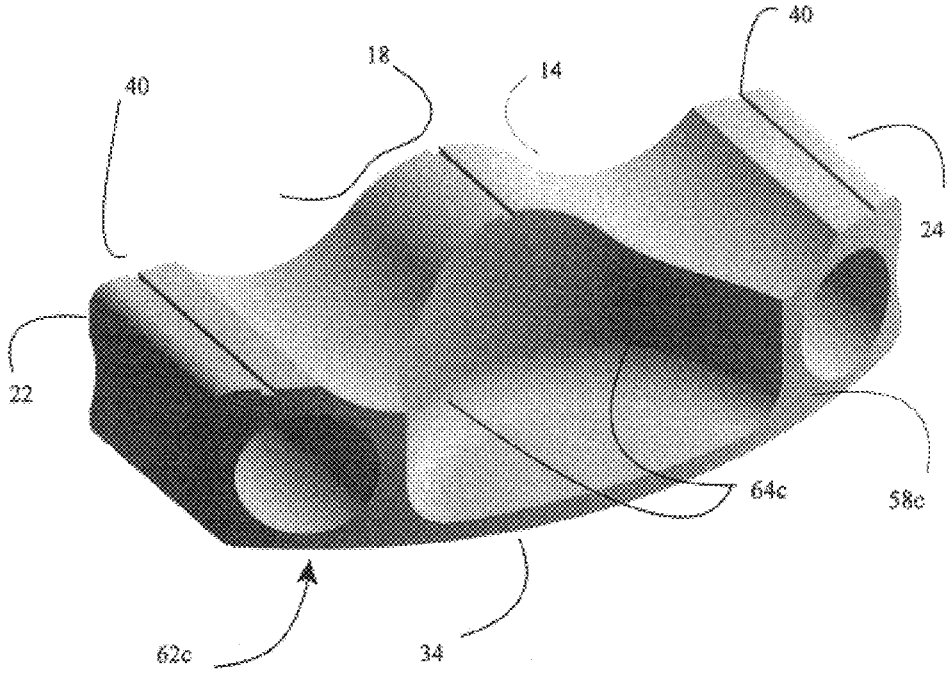
FIG. 15 is a perspective view from the back side of another cavity back embodiment according to the present invention, with a rounded back face and a rounded cavity in the back oriented in the sole-to-top direction, and one putting face.

FIG. 15 A Perspective View of Another Rounded Cavity, Cavity Back Putter Head Embodiment 62*c*

FIG. 15 is a perspective view from the back side of another embodiment of a cavity back putter head 62*c* according to the present invention, with a rounded back face 58*c* and a rounded cavity 64*c* in the back oriented in the sole-to-top direction, with one putting face. A rounded back face 58*c* has the same radius of curvature as the embodiment of FIGS. 13, 14. However, the cavity 64*c* is oriented 90 degrees from the embodiment of FIGS. 13, 14, with the major axis of the cavity 64*c* oriented along the vertical axis of the putter head 62*c* extending through a sole surface 34 and a top surface 18.

As in the embodiment of FIGS. 13, 14, the cavity back putter head 62*c* has only one putting face 14 which may be for left or right hand use depending upon the location of the shaft hole (not shown) as described for FIG. 13. The preferred location of the shaft hole is offset from the center of the putter head towards the putting face 14; for example, the center of the shaft hole may be 0.95 cm (0.38 in) from the extreme limits of the front face 14. Alignment grooves 40 are shown, for example, at the toe 24, heel 22 end and a third equidistant from the toe 24 and heel 22 ends. The alignment grooves may be formed in the extrusion process as in other previously described embodiments.

The rounded cavity, cavity back embodiment 62*c*, may be made with all the lofts, lies, widths, masses, inserts, and shaft locations as the two putting face embodiment of FIGS. 2–6, except 62*c* has only one putting surface. The cavity back head 62*c* has a greater inertia-to-mass ratio as the embodiment of FIGS. 2–6 because of the material removed from the center of the putter head 62*c*. The depth of the cavity 64*c* may be varied for depth, major radius, location, and fillet radius in order to modify the total mass of the cavity back head 62*c*, and its inertia-to-mass ratio. Nominally the depth of the cavity is such to leave, for example, 0.32 cm (0.13 in) in the sole 34. The major radius is nominally, for example, 2.9 cm (1.1 in), and the location of the cavity 64*c* is such that no less than, for example, 1.9 cm (0.75 in) is left for the location of the shaft hole (not shown) in the top surface 18 near the front face 14 for a face-centered embodiment. Other-centered embodiments may require the location of the cavity 64*c* to be moved towards the back face 58*c*, heel 22, toe 24, or other surface. The fillet radius in the cavity 64*c* is, for example, 0.64 cm (0.25 in), and may be altered for manufacturing or esthetic reasons.

Figure 16:
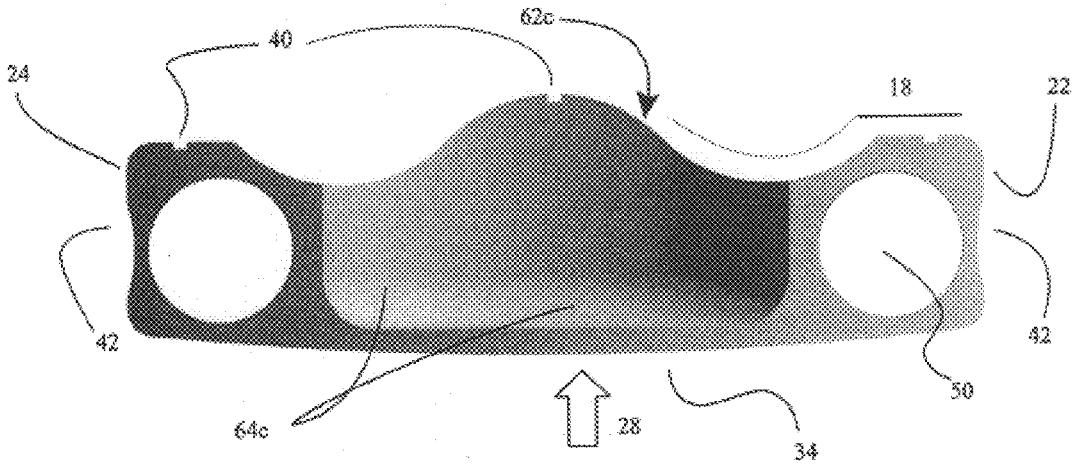
FIG. 16 is a back view of the rounded cavity back embodiment of FIG. 15, illustrating the orientation of the rounded back cavity.

FIG. 16 A Back View of the Rounded Cavity Back Embodiment 62*c*

As in FIG. 14, for FIG. 13, FIG. 16 describes the back view of the rounded cavity back embodiment 62*c* in plan view. The orientation of a cavity 64*c* is clearly different and is rotated 90 degrees from that shown in FIG. 14 around an axis running through the heel 22 to the toe 24. Heel 22 and toe 24 ends of the putter head 62*c* have the same concave contours 42 to spoil putting with either of these ends. A top surface 18 has the same symmetric shape as the embodiments in FIGS. 2–6, 8–11, 13–14 since all of these embodiments may be made from the same extrusion shown in FIG. 1. Alignment grooves 40 may be made in a similar manner in the parent extrusion. In FIG. 16, insert cavity 50 is shown oriented along a putting axis 28; however, the cavities may be oriented along some other axis as necessary, for example from sole 34 to top surface 18. Either one of the two embodiments in FIGS. 13–16 may be made with same lofts, lies, masses, balance properties as the cavity back embodiment of FIGS. 10–11. However, the rounded cavity back embodiments 62*b* and 62*c* may have their respective cavities formed with a fixed radius rotating tool moving along one cutting direction (one degree-of-freedom); the cavity back embodiment 62*a* has a cavity formed by a cutting motion along two directions (two degrees-of-freedom).

Figure 17:
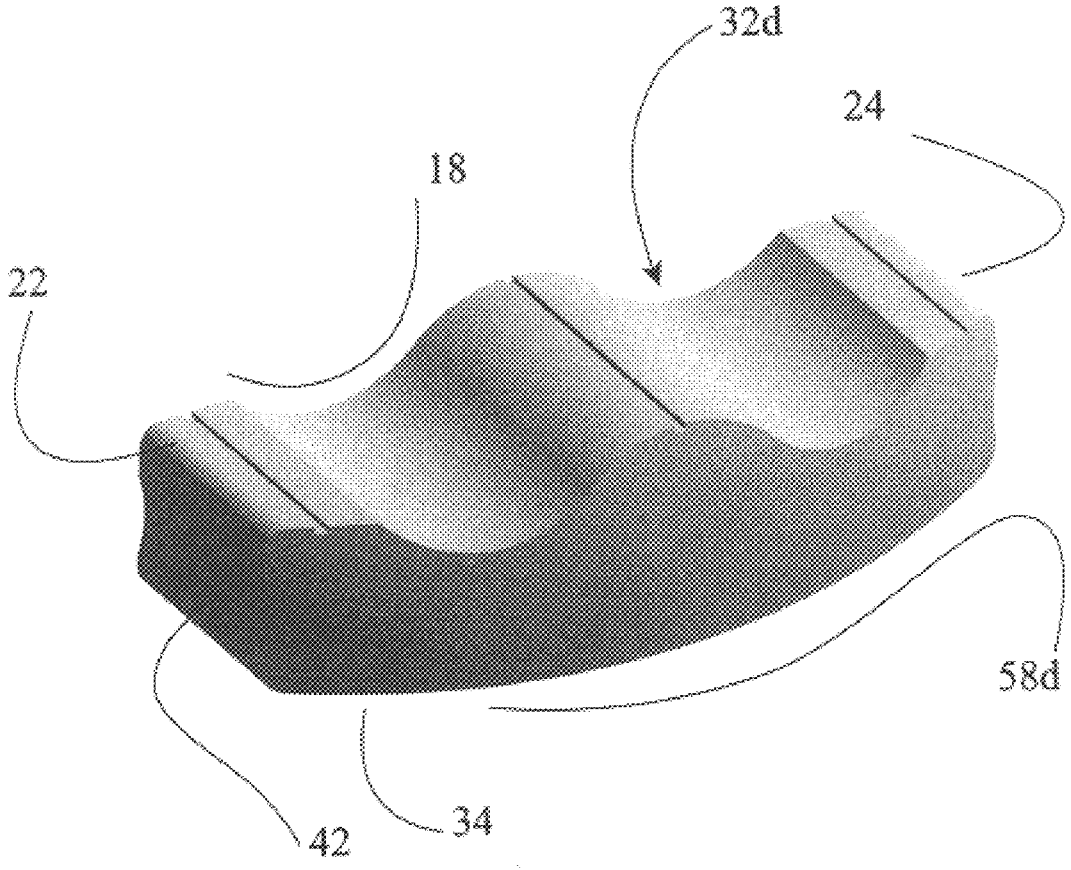
FIG. 17 is a perspective view from the back side of another embodiment according to the present invention, with a dual curvature back face, and one putting face.

FIG. 17 A Perspective View of a Dual Curvature, Rounded Back Embodiment 32*d*

FIG. 17 is a perspective view from the back side of another rounded back embodiment 32*d*, according to the present invention, with a dual curvature back face 58*d* and one putting face. The dual curvature back face 58*d* may have the same major radius of curvature as the embodiments of FIGS. 13–16, which is, for example, 10 cm (4 in) nominally. The dual curvature embodiment of FIG. 17 has in addition a radius of curvature to the round back 58*d* which curves from the sole 34 to the top surface 18 whose purposed is to spoil the back face 58*d* for putting. The radius of curvature from the sole 34 to the top 18 is nominally, for example, 6.4 cm (2.5 in) which may be more or less depending on USGA rulings for single face putters.

The embodiment 32*d* is shown in FIG. 17 without insert cavities, as it would appear if left in the as-extruded form 20 (FIG. 1) without internal cavities 50 (FIG. 3). This particular embodiment 32*d* can be made with the same lofts, lies, masses, and balance properties as the insert embodiments; however, a significantly wider (or denser) head must be used to achieve the same masses of the insert embodiment. Further, the inertia-to-mass ratio would be much lower than the insert embodiments for the same mass since there are no cavities in which to add inertia increasing material. Also, there is much more material in the center of the head 32*d* than in the heads 32, 62*a,* 62*b,* or 62*c*. Insert cavities may be machined into the embodiment of 32*d* as in the other embodiments to alter the mass and the inertia properties, or the cavities may be formed in the extrusion process itself. The toe 24, heel 22, and contours 42, are the same as in these above embodiments.

Figure 18:
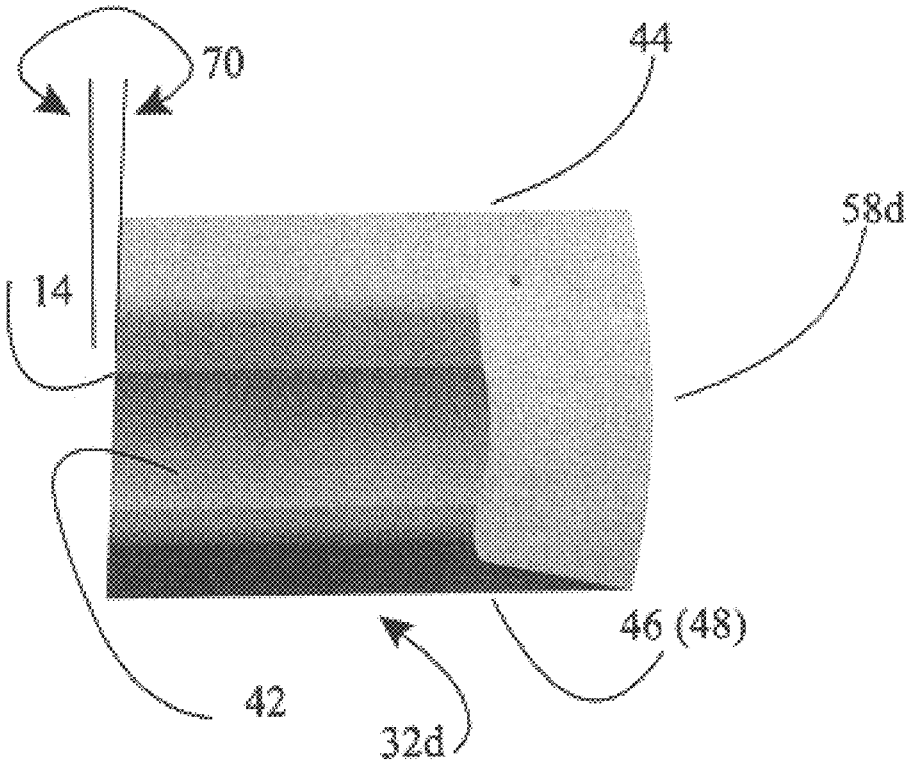
FIG. 18 is a side view of the dual rounded back face embodiment of FIG. 17, illustrating the dual curvature nature of the rounded back and the as-extruded axis of symmetry.

FIG. 18 A Side View of the Dual Curvature, Rounded Back Face Embodiment 32*d*

FIG. 18 is a side view of the dual curvature, rounded back face embodiment 32*d* according to the present invention. The dual radius back 58*d* is clearly shown in the end view. A one putting face, front face 14, with face loft 70 is shown in the end view. The face loft 70 on the face 14 may be identical to the lofts in the embodiments shown in FIGS. 2–6, 8–11, 13–16; for example, a +3 degree included angle from the vertical is shown. A top 44 of the putter head 32*d* is parallel to a bottom surface 46 and sole 48, as shown, and is so formed by the extrusion process. Similarly, a concave contour 42 is shown and so formed by the extrusion process.

Figure 19:
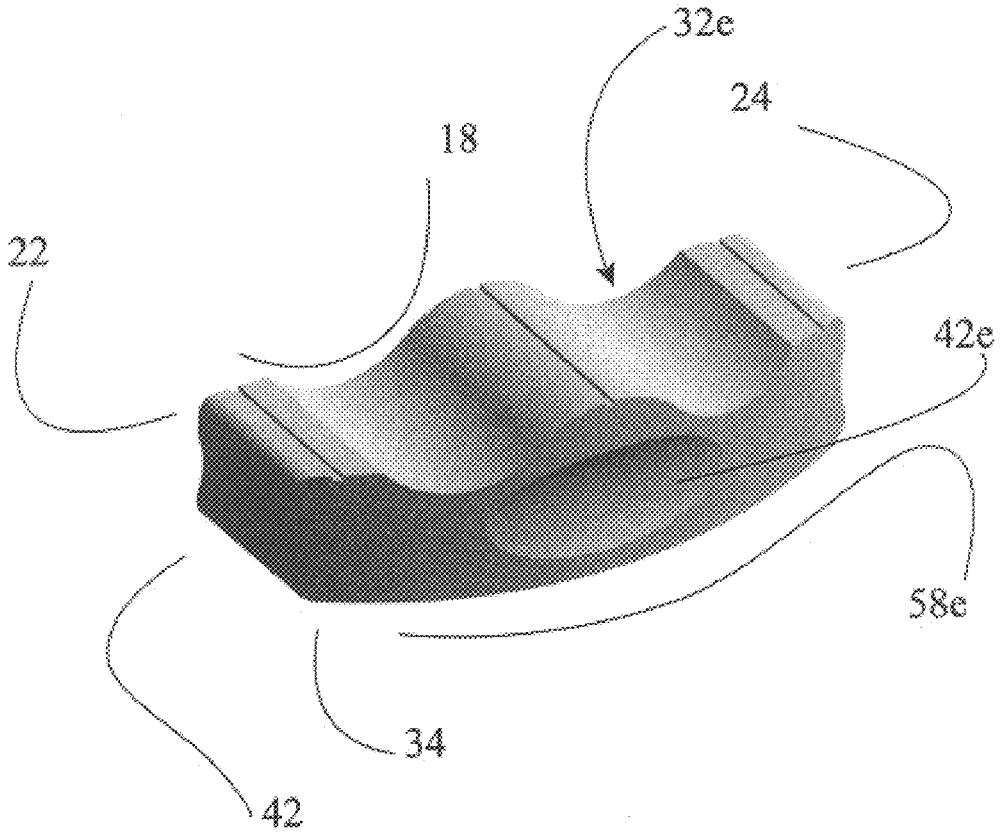
FIG. 19 is a perspective view from the back side of another rounded back embodiment according to the present invention, with a single curvature back containing a large radius concave contour, and one putting face.

FIG. 19 A Perspective View of a Single Curvature, Rounded Back Embodiment 32*e*

FIG. 19 is a perspective view from the back side of another rounded back embodiment 32*e,* according to the present invention, with a single curvature back face 58*e* and one putting face. The single curvature back face 58*e* may have, for example, the same major radius of curvature as the embodiments of FIG. 9, which is, for example, 10 cm (4 in) nominally. The single curvature embodiment of FIG. 19 has in addition a concave contour 42*e* with, for example, a radius of curvature of 3.6 cm (1.4 in), whose length is determined by the depth since the contour 42*e* "runs out" in the toe-to-heel direction, and whose purposed is to spoil the back surface 58*e* for putting. The radius of curvature is, for example, 0.24 cm (0.094 in) deep, and may be modified depending on USGA rulings for single face putters.

The embodiment 32*e* is shown in FIG. 19 without insert cavities, as it would appear if left in the as-extruded form 20 (FIG. 1) without internal cavities 50 (FIG. 3). Embodiment 32*e* can be made with the same lofts, lies, masses, and balance properties as the insert embodiments. The limitations on the inertia-to-mass ratio are the same as in other insert-less embodiments since there are no cavities in which to add inertia increasing material. Insert cavities may be machined into the embodiment of 32*e* as in the other embodiments to alter the mass and the inertia properties, or the cavities may be formed in the extrusion process itself. A toe 24 surface, heel 22 surface, top surface 18, bottom surface 34, and contours 42, are similar to the FIG. 9 embodiment.

Figure 20:
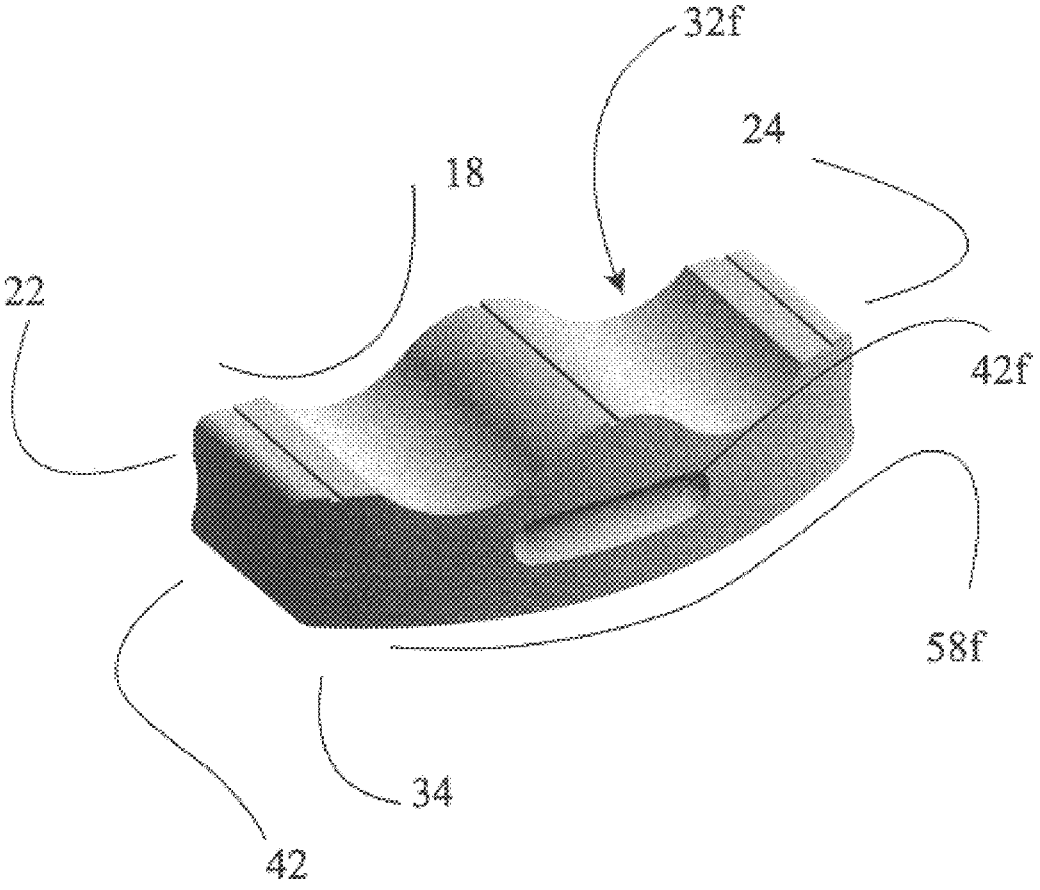
FIG. 20 is a perspective view from the back side of another rounded back embodiment according to the present invention, with a single curvature back containing a small radius concave contour, and one putting face.

FIG. 20 A Perspective View of Single Curvature, Rounded Back Embodiment 32*f*

FIG. 20 is a perspective view from the back side of still another rounded back embodiment 32*f,* according to the present invention, with a single curvature back face 58*f* and one putting face. The single curvature back face 58*f* may have, for example, the same major radius of curvature as the embodiments of FIG. 9, which is, for example, 10 cm (4 in) nominally. The single curvature embodiment of FIG. 20 has in addition a concave contour 42*f* with, for example, a radius of curvature of 0.48 cm (0.19 in), the same radius of curvature on the ends nearest a toe 24 and a heel 22, a depth, for example of 0.32 cm (0.13 in), and length (toe-to-heel) of, for example, 3.8 cm (1.5 inc), whose purposed is to spoil the back face 58*f* for putting.

The embodiment 32*f* is shown in FIG. 20, as the embodiment of FIG. 19, without insert cavities. Embodiment 32*f* can be made with the same lofts, lies, masses, and balance properties as the insert embodiments. The limitations on the inertia-to-mass ratio are the same as in the other insert-less embodiments. Insert cavities may be machined into the embodiment of 32*f* as in the other embodiments to alter the mass and the inertia properties, or the cavities may be formed in the extrusion process itself. A toe 24 surface, heel 22 surface, top surface 18, bottom surface 34, and contours 42, are similar to those of the FIG. 9 embodiment.

Conclusion, Ramification, and Scope

Accordingly, it can be seen that, according to the invention, I have provided a golf putter head with many embodiments which can be made from near-net-shape extrusions, and I have provided the means to make such a putter from extrusions. The symmetry imparted by the extrusion process is used to advantageously manufacture golf putter heads of different face lofts, shaft lies, weighting methods, surface coatings, different masses, and even different embodiments, all from the same extrusion process and many from the same extrusion blank. Different cross sectional embodiments may require different extrusion dies, but would be manufactured through the same extrusion and machining process to produce embodiments with their own families of lofts, lies, masses, etc. Each of these embodiments achieve the goals of ease of manufacturability, high inertia-to-mass ratio, and adaptation to the different physical needs of golfers.

Although the description above contains many specifics, these should not be construed as limiting the scope of the invention but as merely providing illustrations of some of the presently preferred embodiments of this invention. Various other embodiments and ramifications are possible within it's scope. For example, for each of the previously described embodiments, the two conic cylinders 30 which serve as inertia enhancers may be eliminated as well as the manufacturing steps to machine the two conic cylinders 30 into the extrusion banks and steps to fill these heel 22 and toe 24 inserts 26 with more massive material. Thus, this embodiment retains all the characteristics of the previously mentioned embodiments, but with a lower manufacturing cost at the expense of a reduced inertia-to-mass ratio.

Another embodiment of this invention uses even more massive (dense) inserts 26 at the heel 22 and the toe 24 locations. Such material could be tungsten, Liquid-Metal (TM), or other materials with a high specific gravity. Material with a relatively high resistance to indentation would be used if the insert material would be subject to repeated contact with golf balls.

Another embodiment of this invention uses different locations of the mass inserts other than at the heel 22 and toe 24 aligned with the axis of extrusion. The cavities for the inserts could be machined in another surface such as the top surface contour 18, the sole surface 34, in the heel 22, or toe 24, or both, or all, for example. Still other embodiments could place the mass inserts into a rounded back 58, 58*e*, 58*f* surface, or from a back surface which is not round as in the cavity back 62*a, b, c, d* embodiments. All these combinations could be machined into very high inertia-to-mass ratio embodiments.

Embodiments of this invention which use different extrusions of different materials (more or less dense, more or less hard) than the parent extrusion material can be combined by fasteners, epoxy, blast-forming, or other physical attachment methods. These embodiments marry materials with different material properties but with the same cross-sectional outline to achieve at least one front putter face 14 of extruded material combined with a main body of extruded material. These face materials include elastomers {butadiene-styrene, neoprene, nitrile rubbers, butyl (°Shore hardness 40–90), ethylene-propylene, etc. } of considerable less hardness than that of the putter body (for example aluminum 6105-T5 with BHN 95). The face material also need not be extruded but molded by some other method such as injection casting into a mold of similar shape of the extrusion, or injected or cast into a cavity on the extrusion itself before or after the machining of the putter face(s). These embodiments would still retain the efficiencies and many properties of the near net-shape extrusion process.

Golf heads other than those for putting may be produced with similar techniques of extrusion and machining in order to achieve embodiments of golf woods heads and golf irons heads. The extruded shape golf woods heads and golf irons heads would share the aligned and uniform grain structure, high precision and uniform physical properties, surface coatings, different mass and inertia altering cavities from the same extrusion, locking mechanisms for mass and inertia altering inserts, assembly methods and other equipment so to be made into golf clubs, and would be able to be manufactured in large quantities with different head lofts, lies, widths, masses, and shapes from the same extrusion bar. The major restrictions for the shapes and configurations on extruded golf club heads are those set by the USGA rulings, not by the physical process of extruding the heads.

This process of extrusion lends itself particularly well to the extrusion of a shell of a golf club head, for example, a wood club head, where a face material could be joined to the shell to form a striking face. The back face could be formed by closing the shell's parameter and joining the edges, or another piece of material joined to the back in a manner similar to that of the front striking face. The advantage to this structure is the extremely low manufacturing cost of extruding the shell with very low wall thickness variations and uniform and controllable physical properties. The placement of material in the shell's walls could be chosen and maintained with precision {±0.03 cm (0.01 in) or less, for example } well beyond that of casting methods; further, the grain structure would be aligned with the impact of the ball on the club face.

Another embodiment of this invention is the extrusion of golf club iron heads. The profile of the irons, from the club face to the back face axis perspective, could be machined into an extrusion die while including the profile of the hosel if required. The same general cross sectional profile or a family of cross sectional profiles could be used for the different lofted iron clubs, for example, one iron and greater. Each individual iron head could be cut or machined from the extruded bar much the same as the golf putter heads described herein. The extruded iron heads would retain the high precision, uniform properties, including aligned grain structure, as in the putter head embodiments. The extruded head embodiments preferred material may be, for example, of a more dense material than aluminum, stainless steel or titanium, for example, since both may be readily extruded. Any club head used in golf can be produced economically with low cost and high precision with the hereto described extrusion process.

I claim:

1. A golf club head for striking a golf ball comprising:

a. a club head body having a toe face, a heel face, a top face, a sole face, a front face, and a back face, said club head body being wholly extruded into a substantially extruded bar shape with said bar having at least one axis of symmetry, said club head body substantially retaining the profile of the extrusion;

b. said club head body having a modified grain structure along said axis of symmetry with said grain structure further modified by a subsequent stretching of said bar in a predetermined manner;

c. said club head body including a tensile strength, a yield strength, a surface hardness, and a ductility obtained through the subsequent stretching of said bar;

d. each of said tensile strength, said yield strength, said surface hardness, and said ductility of said club head body being further modified by a heat treating and tempering of said bar in a predetermined manner.

2. A golf club head according to claim 1, wherein the club head is a putter head.

3. A golf club head according to claim 1, wherein the club head is a putter head comprising:

a. said putter head having a surface coating achieved by means selected from the group consisting of anodizing, painting and powder coating;

b. said putter head has alignment marks for aligning said head with the intended trajectory of a golf ball;

c. said putter head has at least one ball striking surface;

d. said putter head has mass altering cavities located in said head selected from the group consisting of heel cavities, toe cavities, top cavities, sole cavities and face cavities;

e. said putter head has said cavities of (d.) filled with a material selected from the group consisting of less dense and more dense material than said extrusion;

f. said putter head has said material of (e.) locked in place within said cavities of (d.) employing a mechanism selected from the group consisting of a portion of opposing outwardly tapered conic sections with the taper of the interior diameter less than the taper of the outer diameter, opposing inwardly tapered conic sections with the taper of the interior diameter greater than the taper of the outer diameter, and an inwardly tapered conic section with the taper of the interior diameter greater than the outer taper of the diameter;

g. said putter head has heel and toe surfaces with profiles on said surfaces to prevent said surfaces from being used as additional ball striking surfaces;

h. said putter head has a shaft attachment means for attaching a shaft in a predetermined location to promote different balancing properties selected from the group consisting of center balancing, face balancing, toe balancing, heel balancing, and quarter balancing;

i. said putter head has a width machined in a predetermined manner to create a predetermined mass of said head from said bar;

j. said putter head has a shape machined in a predetermined manner to create said head with a style selected from the group consisting of two putting face styles, one putting face styles, cavity back styles, and rounded back styles;

k. said putter head has said style of (j.) machined for a mass balance property selected from the group consisting of center balancing, face balancing, toe balancing, heel balancing, and quarter balancing;

l. said putter head has said material of (e.) selected from the group consisting of lead, and lead alloy other dense alloys; said other dense alloys selected from the group consisting of bearing babbitt, monotype, and foundry lead; said monotype and foundry lead expand upon cooling;

m. said putter head has the locked material of (f.) wherein said material is placed in said cavity in a state selected from the group consisting of a molten state, and a solid state;

n. said putter head has the material of (e.) modified by compression in said cavity after insertion in said state;

o. said putter head has said material of (f.) held in place by the interaction of the tapered walls and the shear strength of said material.

* * * * *